US009618166B2

(12) United States Patent
Jiang et al.

(10) Patent No.: US 9,618,166 B2
(45) Date of Patent: Apr. 11, 2017

(54) LED TUBE LAMP

(71) Applicant: JIAXING SUPER LIGHTING ELECTRIC APPLIANCE CO., LTD, Jiaxing (CN)

(72) Inventors: Tao Jiang, Jiaxing (CN); Wen-Jang Jiang, Hsinchu (TW); Shau-Liang Chen, Hsinchu (TW); Xiao-Su Yang, Jiaxing (CN)

(73) Assignee: Jiaxing Super Lighting Electric Applianc Co., Ltd., Jiaxing, Zhejiang (CN)

( * ) Notice: Subject to any disclaimer, the term of this patent is extended or adjusted under 35 U.S.C. 154(b) by 0 days.

(21) Appl. No.: 14/818,204

(22) Filed: Aug. 4, 2015

(65) Prior Publication Data

US 2016/0290568 A1 Oct. 6, 2016

Related U.S. Application Data

(63) Continuation-in-part of application No. 14/677,899, filed on Apr. 2, 2015, and a continuation-in-part of application No. 14/724,840, filed on May 29, 2015.

(30) Foreign Application Priority Data

Sep. 28, 2014 (CN) ..... 2014 1 0507660
Sep. 28, 2014 (CN) ..... 2014 1 0508899
(Continued)

(51) Int. Cl.
*F21V 21/00* (2006.01)
*F21K 9/27* (2016.01)
(Continued)

(52) U.S. Cl.
CPC ..... *F21K 9/27* (2016.08); *F21Y 2103/10* (2016.08); *F21Y 2115/10* (2016.08); *H01R 13/6205* (2013.01)

(58) Field of Classification Search
CPC ..... F21Y 2103/00; F21K 9/175; F21K 9/17; F21K 9/1355; F21K 9/30; F21V 23/06;
(Continued)

(56) References Cited

U.S. PATENT DOCUMENTS 2,454,049 A * 11/1948 Floyd, Jr. ..... H01G 4/02 361/303
3,294,518 A 12/1966 Laseck
(Continued)

FOREIGN PATENT DOCUMENTS

CN 201437921 4/2010
CN 102116460 7/2011
(Continued)

*Primary Examiner* — Jong-Suk (James) Lee
*Assistant Examiner* — Tsion Tumebo
(74) *Attorney, Agent, or Firm* — Muir Patent Law, PLLC

(57) ABSTRACT

An end cap for LED tube lamp along with the LED tube lamp adopting thereof is disclosed. LED tube lamp includes a lamp tube. One end of the lamp tube is attached to the end cap; a LED light bar is disposed inside the lamp tube. The end cap includes an insulating tubular part, sleeved with the end of the lamp tube and a magnetic object disposed between an inner circumferential surface of the insulating tubular part and the end of the lamp tube. The magnetic object being of a magnetic metal member and the lamp tube are adhesively bonded by a hot melt adhesive. An inner circumferential surface of the magnetic metal member can be fully covered by the hot melt adhesive. Magnetic metal member can be in the structure of a circular or oval ring, with at least one opening, and has indentation structure on a surface thereof.

21 Claims, 15 Drawing Sheets

(30) Foreign Application Priority Data

Nov. 6, 2014 (CN) ..... 2014 1 0623355
Dec. 5, 2014 (CN) ..... 2014 1 0734425
Feb. 12, 2015 (CN) ..... 2015 1 0075925
Mar. 27, 2015 (CN) ..... 2015 1 0136796

(51) Int. Cl.
*H01R 13/62* (2006.01)
*F21Y 103/10* (2016.01)
*F21Y 115/10* (2016.01)

(58) Field of Classification Search
CPC ..... F21V 19/008; F21V 23/002; F21V 29/89; F21V 15/015; F21V 3/0418; F21V 17/101; F21V 17/14; F21V 19/002; F21V 19/003; F21V 21/32; F21V 31/04
USPC ..... 362/217.12, 217.13, 217.17, 219; 439/230, 240, 242, 56, 38–40
See application file for complete search history.

(56) References Cited

U.S. PATENT DOCUMENTS 4,156,265 A 5/1979 Rose
4,647,399 A 3/1987 Peters et al.
5,575,459 A 11/1996 Anderson
5,921,660 A 7/1999 Yu
6,118,072 A 9/2000 Scott
6,127,783 A 10/2000 Pashley
6,211,262 B1 4/2001 Mejiritski et al.
6,609,813 B1 8/2003 Showers
6,796,680 B1 9/2004 Showers
6,936,855 B1 8/2005 Harrah et al.
7,033,239 B2 4/2006 Cunkelman
7,067,032 B1 * 6/2006 Bremont ..... F16L 13/103 156/272.2
7,594,738 B1 * 9/2009 Lin ..... F21V 23/006 362/218
8,360,599 B2 1/2013 Ivey
8,456,075 B2 * 6/2013 Axelsson ..... F21V 17/04 313/312
8,579,463 B2 11/2013 Clough
D761,216 S 7/2016 Jiang
9,447,929 B2 9/2016 Jiang
D768,891 S 10/2016 Jiang et al.
2002/0044456 A1 4/2002 Balestriero
2003/0231485 A1 12/2003 Chien
2004/0095078 A1 5/2004 Leong
2004/0189218 A1 9/2004 Leong
2005/0128751 A1 6/2005 Roberge
2005/0162850 A1 7/2005 Luk
2005/0207166 A1 9/2005 Kan
2005/0213321 A1 9/2005 Lin
2006/0028837 A1 2/2006 Mrakovich et al.
2007/0001709 A1 1/2007 Shen
2007/0145915 A1 6/2007 Roberge
2007/0210687 A1 9/2007 Axelsson
2007/0274084 A1 11/2007 Kan
2008/0030981 A1 2/2008 Mrakovich
2008/0192476 A1 * 8/2008 Hiratsuka ..... F21V 7/09 362/285
2008/0278941 A1 11/2008 Logan
2008/0290814 A1 11/2008 Leong et al.
2009/0159919 A1 * 6/2009 Simon ..... F21K 9/58 257/99
2009/0161359 A1 6/2009 Siemiet
2010/0253226 A1 10/2010 Oki
2011/0038146 A1 2/2011 Chen
2011/0057572 A1 3/2011 Kit et al.
2011/0090684 A1 4/2011 Logan
2011/0216538 A1 9/2011 Logan
2012/0049684 A1 * 3/2012 Bodenstein ..... F03D 9/002 310/156.12
2012/0069556 A1 3/2012 Bertram
2012/0106157 A1 5/2012 Simon
2012/0153873 A1 6/2012 Hayashi
2012/0169968 A1 7/2012 Ishimori et al.
2012/0293991 A1 11/2012 Lin
2012/0319150 A1 12/2012 Shimomura et al.
2013/0021809 A1 * 1/2013 Dellian ..... H01R 33/96 362/457
2013/0033881 A1 * 2/2013 Terazawa ..... F21K 9/1375 362/382
2013/0033888 A1 2/2013 Wel et al.
2013/0050998 A1 2/2013 Chu et al.
2013/0170245 A1 7/2013 Hong
2013/0182425 A1 7/2013 Seki
2013/0250565 A1 * 9/2013 Chiang ..... F21K 9/175 362/217.17
2013/0256704 A1 10/2013 Hsiao et al.
2014/0071667 A1 3/2014 Hayashi
2014/0153231 A1 * 6/2014 Bittmann ..... F21K 9/1355 362/217.14
2014/0226320 A1 8/2014 Halliwell
2015/0009688 A1 1/2015 Timmermans
2016/0091147 A1 3/2016 Jiang et al.
2016/0091156 A1 3/2016 Li et al.
2016/0091179 A1 3/2016 Jiang et al.
2016/0102813 A1 4/2016 Ye et al.
2016/0178135 A1 6/2016 Xu et al.
2016/0178137 A1 6/2016 Jiang
2016/0178138 A1 6/2016 Jiang
2016/0198535 A1 7/2016 Ye et al.
2016/0212809 A1 7/2016 Xiong et al.
2016/0215936 A1 7/2016 Jiang
2016/0215937 A1 7/2016 Jiang
2016/0219658 A1 7/2016 Xiong et al.
2016/0219666 A1 7/2016 Xiong et al.
2016/0219672 A1 7/2016 Liu
2016/0223180 A1 8/2016 Jiang
2016/0223182 A1 8/2016 Jiang
2016/0229621 A1 8/2016 Jiang et al.
2016/0255694 A1 9/2016 Jiang et al.
2016/0255699 A1 9/2016 Ye et al.
2016/0270163 A1 9/2016 Hu et al.
2016/0270164 A1 9/2016 Xiong et al.
2016/0270165 A1 9/2016 Xiong et al.
2016/0270166 A1 9/2016 Xiong et al.
2016/0270173 A1 9/2016 Xiong
2016/0270184 A1 9/2016 Xiong et al.
2016/0290566 A1 10/2016 Jiang et al.
2016/0290567 A1 10/2016 Jiang et al.
2016/0290568 A1 10/2016 Jiang et al.
2016/0290569 A1 10/2016 Jiang et al.
2016/0290570 A1 10/2016 Jiang et al.
2016/0290598 A1 10/2016 Jiang
2016/0290609 A1 10/2016 Jiang et al.
2016/0295706 A1 10/2016 Jiang
2016/0309550 A1 10/2016 Xiong et al.
2016/0323948 A1 11/2016 Xiong et al.
2016/0341414 A1 11/2016 Jiang
2016/0356472 A1 12/2016 Liu et al.
2016/0363267 A1 12/2016 Jiang et al.
2016/0381746 A1 12/2016 Ye et al.
2016/0381760 A1 12/2016 Xiong et al.
2017/0001793 A1 1/2017 Jiang et al.

FOREIGN PATENT DOCUMENTS

CN 102121578 7/2011
CN 202125774 1/2012
CN 102518972 6/2012
CN 102518972 A 6/2012
CN 102720901 10/2012
CN 102777788 11/2012
CN 102889446 1/2013
CN 203240337 10/2013
CN 203240337 U 10/2013
CN 203240337 U 10/2013
CN 203363984 12/2013
CN 203384716 U 1/2014

(56) References Cited

FOREIGN PATENT DOCUMENTS

| | | | |
|---|---|---|---|
| CN | 203413396 | U | 1/2014 |
| CN | 203453866 | U | 2/2014 |
| CN | 103742875 | | 4/2014 |
| CN | 203585876 | U | 5/2014 |
| CN | 203615157 | | 5/2014 |
| CN | 103851547 | | 6/2014 |
| CN | 203771102 | | 8/2014 |
| CN | 203927469 | | 11/2014 |
| CN | 204268162 | | 4/2015 |
| CN | 204300737 | | 4/2015 |
| CN | 104595765 | | 5/2015 |
| CN | 204420636 | | 6/2015 |
| CN | 104776332 | | 7/2015 |
| CN | 204573639 | | 8/2015 |
| GB | 2523275 | | 8/2015 |
| JP | 2008117666 | | 5/2008 |
| JP | 2011061056 | | 3/2011 |
| JP | 2014154479 | | 8/2014 |
| KR | 20120000551 | | 1/2012 |
| WO | 2011/132120 | A1 | 10/2011 |
| WO | WO2011/132120 | | 10/2011 |
| WO | 2013/125803 | A1 | 8/2013 |
| WO | WO2013/125803 | | 8/2013 |
| WO | 2014/001475 | A1 | 1/2014 |
| WO | WO2014/001475 | | 1/2014 |
| WO | WO 2014/118754 | | 8/2014 |
| WO | 2015/036478 | A1 | 3/2015 |
| WO | WO2015/036478 | | 3/2015 |

* cited by examiner

LED TUBE LAMP

FIELD OF THE INVENTION

The present invention relates to illumination device, and more particularly to an end cap for an LED tube lamp adapted for use together with an LED tube lamp.

BACKGROUND OF THE INVENTION

Today LED lighting technology is rapidly replacing traditional incandescent and fluorescent lights. Even in the tube lamp applications, instead of being filled with inert gas and mercury as found in fluorescent tube lamps, the LED tube lamps are mercury-free. Thus, it is no surprised that LED tube lamps are becoming highly desired illumination option among different available lighting systems used in homes and workplace, which used to be dominated by traditional lighting options such as compact fluorescent light bulbs (CFLs) and fluorescent tube lamps. Benefits of the LED tube lamps include improved durability and longevity, and far less energy consumption, therefore, when taking into of all factors, they would be considered as cost effective lighting option.

There are several types of LED tube lamps that are currently available on the market today. Many of the conventional LED tube lamp has a housing that use material such as an aluminum alloy combined with a plastic cover, or made of all-plastic tube construction. The lighting sources usually adopt multiple rows of assembled individual chip LEDs (single LED per chip) being welded on circuit boards, and the circuit boards are secured to the heat dissipating housing. Because this type of aluminum alloy housing is a conductive material, thus is prone to result in electrical shock accidents to users. In addition, the light transmittance of the plastic cover or the plastic tube diminish over time due to aging, thereby reducing the overall lighting or luminous efficiency of the conventional LED tube lamp. Furthermore, grainy visual appearance and other derived problems reduce the luminous efficiency, thereby reducing the overall effectiveness of the use of LED tube lamp. The LED light sources are typically a plurality of spatially arranged LED chips. With respect to each LED chip, due to its intrinsic illumination property, if there was no any sufficient further optical processing, the entire tube light will exhibit grainy or non-uniform illumination effect; as a result, grainy effect is produced to the viewer or user, thereby negatively affect visual aesthetics thereof. In other words, the overall illumination distribution uniformity of the light outputted by the LED light sources without having additional optical processing techniques or structures for modifying the illumination path and uniformity would not be sufficient enough to satisfy the quality and aesthetics requirements of average consumers.

Referring to US patent publication no. 2014226320, as an illustrative example of a conventional LED tube lamp, the two ends of the tube are not curved down to allow the end caps at the connecting region with the body of the lamp tube (including a lens, which typically is made of glass or clear plastic) requiring to have a transition region. During shipping or transport of the LED tube lamp, the shipping packaging support/bracket only makes direct contact with the end caps, thus rendering the end caps as being the only load/stress points, which can easily lead to breakage at the transition region with the glass lens.

With regards to the conventional technology directing to glass tube of the LED tube lamps, LED chip on board is mounted inside the glass-tubed tube lamp by means of adhesive. The end caps are made of a plastic material, and are also secured to the glass tube using adhesive, and at the same time the end cap is electrically connected to the power supply inside tube lamp and the LED chip on boards. This type of LED tube lamp assembly technique resolves the issue relating to electrical shocks caused by the housing and poor luminous transmittance issues. But this type of conventional tube lamp configured with the plastic end caps requires a tedious process for performing adhesive bonding attachment because the adhesive bonding process requires a significant amount of time to perform, leading to production bottleneck or difficulties. In addition, manual operation or labor are required to perform such adhesive bonding process, thus would be difficult for manufacturing optimization using automation. In addition, sometimes the end cap and the glass lamp tube may come apart from one another when the adhesive does not sufficiently bond the two, thus the detachment of the end cap and the glass lamp tube can be a problem yet to be solved.

In addition, the glass tube is a fragile breakable part, thus when the glass tube is partially broken in certain portion thereof, would possibly contact the internal LED chip on boards when illuminated, causing electrical shock incidents. Referring to Chinese patent publication no. 102518972, which discloses the connection structure of the lamp caps and the glass tube, as shown in FIG. 1 of the aforementioned Chinese patent reference, it can be seen that the lamp end cap protrudes outward at the joining location with the glass tube, which is commonly done in the conventional market place. According to conducted studies, during the shipping process of the LED tube lamps, the shipping packaging support/bracket only makes contact with the lamp end caps, which make the end caps as being the only load/stress points, which can easily lead to breakage at the transition coupling regions at the ends of the glass tube. In addition, with regards to the secure mounting method of the lamp end caps and the glass tube, regardless of whether using hot melt adhesive or silicone adhesive, it is hard to prevent the buildup and light blockage of excess (overflown) leftover adhesive residues, as well as having unpleasant aesthetic appearance thereof. In addition, large amount of manpower is required for cleaning off of the excessive adhesive buildup, creating further production bottleneck and inefficiency. As shown also from FIGS. 3 and 4 of the aforementioned Chinese patent application, the LED lighting elements and the power supply module require to be electrically connected via wire bonding technique, and can be a problem or issue during shipping due to the concern of breakage.

Based on the above, it can be appreciated that the LED tube lamp fabricated according to the conventional assembly and fabrication methods in mass production and shipping process can experience various quality issues and are in need of improvements to be made. Referring to US patent publication no. 20100103673, which discloses of an end cap substitute for sealing and inserting into the housing. However, based on various experimentation, upon exerting a force on the glass housing, breakages can easily occur, which lead to product defect and quality issues. Meanwhile, grainy visual appearances are also often found in the aforementioned conventional LED tube lamp.

SUMMARY OF THE INVENTION

To solve at least one of the above problems, the present invention provides an LED tube lamp having an LED light bar, in which the LED light bar is a bendable circuit sheet.

The present invention provides an LED tube lamp that includes a plurality of LED light sources, a LED light bar, a lamp tube, at least one end cap and at least one power supply.

The present invention provides the LED light bar to be disposed inside the lamp tube, the LED light sources are mounted on the LED light bar, the LED light sources and the power supply are electrically connected by the LED light bar.

In an embodiment of the present invention, two end caps are provided, in which each end cap is equipped with one power supply. The sizes of the two end caps are different in some embodiments, and the size of one end cap is 30%-80% of the size of the other end cap in some other embodiments.

The present invention provides the chip LEDs/chip LED modules mounted and fixed on the inside wall of the glass lamp tube by a bonding adhesive.

In alternative embodiment, the lamp tube can be a plastic tube, and in several embodiments, the lamp tube is a glass tube. In a preferred embodiment, the lamp tube can be a transparent glass tube, or a glass tube with coated adhesive film on the inner walls thereof.

The present invention provides the LED light bar being the bendable circuit sheet to include a wiring layer and a dielectric layer, the LED light sources are disposed on the wiring layer and are electrically connected to the power supply by the wiring layer therebetween, the wiring layer and the dielectric layer are stackingly arranged, the dielectric layer is disposed on a surface of the wiring layer which is away from the LED light sources, and is fixed to an inner circumferential surface of the lamp tube. Furthermore, the bendable circuit sheet (the LED light bar) is extending along a circumferential direction of the lamp tube, the circumferential length of the bendable circuit sheet along the inner circumferential surface of the lamp tube and the circumferential length of the inner circumferential surface of the lamp tube is at a ratio of 0.3 to 0.5. Moreover, the bendable circuit sheet can further include a circuit protection layer, the circuit protection layer can be of one layer, and the circuit protection layer can be disposed on an outermost layer of the wiring layer of the bendable circuit sheet. In another preferred embodiment, the bendable circuit sheet further includes a circuit protection layer being of two layers respectively disposed on outermost layers of the wiring layer and the dielectric layer of the bendable circuit sheet.

In embodiments of the present invention, the bendable circuit sheet can be electrically connected to the power supply by wire bonding or by soldering, not to be fixed to an inner circumferential surface of the lamp tube by forming a freely extending end portion at the two ends thereof, respectively.

The present invention provides the lamp tube to include a main region, a transition region, and a plurality of rear end regions, wherein a diameter of one of the rear end regions is less than a diameter of the main region, and the one of the rear end regions of the lamp tube is fittingly sleeved with the end cap. The transition region is formed between the main region and the rear end region. The present invention provides the bendable circuit sheet to pass through the transition region and to be electrically connected to the power supply. The present invention provides each of the transition regions to have a length of 1 mm to 4 mm in some embodiments, but other lengths are also possible for the transition region.

The present invention provides the LED tube lamp to further comprising a diffusion film layer and a reflective film layer, in which the diffusion film layer is disposed above the LED light sources, the light emitting from the LED light sources is passed through the diffusion film layer and the lamp tube. Furthermore, the reflective film layer is disposed on an inner circumferential surface of the lamp tube, and the bendable circuit sheet is disposed on the reflective film layer or one side of the reflective film layer. A ratio of a circumferential length of the reflective film layer fixed along an inner surface of the lamp tube and a circumferential length of the lamp tube is 0.3 to 0.5.

In a preferred embodiment, the diffusion film layer is made of a diffusion coating comprising at least one of calcium carbonate, halogen calcium phosphate and aluminum oxide, a thickening agent, and a ceramic activated carbon.

In an embodiment of the present invention, the diffusion film layer is an optical diffusion coating coated on an inner wall or an outer wall of the lamp tube.

In another embodiment of the present invention, the diffusion film layer is an optical diffusion coating coated directly on a surface of the LED light sources.

In another embodiment of the present invention, the diffusion film layer is an optical diffuser covering above the LED light sources without directly contacting thereof.

In one embodiment of the present invention, a reflective film layer is disposed on an inner circumferential surface of the lamp tube, and occupying a portion of the inner circumferential surface of the lamp tube along a circumferential direction thereof. The LED light bar can be bondedly attached to the inner circumferential surface of the lamp tube, and the reflective film layer can be contacting one end or two ends of the LED light bar when extending along the circumferential direction of the lamp tube. The LED light bar can be disposed above the reflective film layer or adjacently to one side of the reflective film layer.

The present invention provides the LED tube lamp to further comprising a reflective film layer. The reflective film layer is disposed on an inner circumferential surface of the lamp tube, the LED light bar is disposed on the reflective film layer or one side of the reflective film layer.

In one embodiment of the present invention, the reflective film layer can be divided into two distinct sections of a substantially equal area, the LED light bar are disposed in between the two distinct sections of the reflective film layer.

In yet another embodiment of the present invention, the LED light sources are disposed on the inner circumferential surface of the lamp tube, the reflective film layer has one or more openings configured and arranged to locations of the LED light sources correspondingly, and each of the LED light sources is disposed in one of the one or more openings of the reflective film layer, respectively.

In yet another embodiment of the present invention, the thickness of the diffusion film layer arranges from 20 μm to 30 μm.

In yet another embodiment of the present invention, the ratio of light transmittance of the diffusion film layer arranges from 85% to 96%.

In yet another embodiment of the present invention, the ratio of the light transmittance of the diffusion film layer arranges from 92% to 94% while the thickness of the diffusion film layer arranges from 200 μm to 300 μm.

The present invention provides another embodiment for the LED tube lamp, in which the LED light bar being the bendable circuit sheet, includes a plurality of wiring layers and a plurality of dielectric layers, the dielectric layers and the wiring layers are sequentially and staggerly stacked, respectively, on a surface of one wiring layer that is opposite from the surface of another wiring layer that has the LED light sources disposed thereon, the LED light sources are disposed on an uppermost layer of the wiring layers, and are electrically connected to the power support by the uppermost layer of the wiring layers.

The present invention provides a hot melt adhesive to bond together the end cap and the lamp tube, thus allowing for realization of manufacturing automation for LED tube lamps.

The present invention provides the power supply for the LED tube lamp may be in the form of a singular unit, or two individual units, and the power supply can be purchased readily from the marketplace because it is of conventional design.

The present invention provides the LED light bar to be adhesively mounted and secured on the inner wall of the lamp tube, thereby having an illumination angle of at least 330 degrees.

In a preferred embodiment, the lamp tube can be a transparent glass tube, or a glass tube with coated adhesive film on the inner walls thereof.

To solve one of the above problems, the present invention provides a LED tube lamp having a substantially uniform exterior diameter from end to end thereof by having a glass lamp tube having one or more narrowly curved end regions at two ends thereof for engaging with a plurality of end caps, and the end caps are enclosing around the narrowly curved end regions of the glass lamp tube, in which the outer diameter of the end caps is substantially equal to the outer diameter of the lamp tube thereby forming the LED tube lamp of substantially uniform exterior diameter from end to end thereof.

The present invention provides an LED tube lamp that includes a plurality of chip LEDs, an LED light bar, a lamp tube, at least two end caps, an insulation adhesive, an optical adhesive, a hot melt adhesive, a bonding adhesive, and at least one power supply.

The present invention provides the chip LEDs/(chip LED modules) mounted and fixed on the inside wall of the glass lamp tube by the bonding adhesive. The chip LED has a female plug, and containing a LED light source. The end cap is configured with a plurality of hollow conductive pins, and a power supply installed therein, where the power supply at one end thereof has a male plug, while the other end thereof has a metal pin. The male plug of the power supply is engageably fittingly inserted into the female plug of the chip LED. The other end of the power supply with the metal pin is inserted into the hollow conductive pin, thereby enabling an electrical connection. The power supply can be of one singular unit (which is disposed in one end cap) or two units located in two end caps, respectively. In an embodiment having a singular narrowly curved end region and a singular power supply, the power supply is preferred to be disposed in the end adjacent to the corresponding singular narrowly curved end region of the glass tube.

The present invention provides the insulation adhesive coated and encapsulated over the chip LEDs, while the optical adhesive is coated and encapsulated over the surfaces of the LED light source (LED chip). Thus, the entire chip LED is thereby electrically insulated from the outside, so that even when the lamp tube is partially broken into pieces, would not cause electrical shock. The end caps are secured by using a hot melt adhesive, for completing the assembling of the LED tube lamp of present invention.

The present invention provides the glass lamp tube to be curved and narrowly at the opening regions or end regions thereof, so as to be narrower in diameter at the ends thereof. The hot melt adhesive is used to secure the end caps to the narrowly curved end region of the lamp tube, so that the end region is restricted to a "transition region". The hot melt adhesive is prevented from spillover or forming a flash region due to the presence of excessive adhesive residues. The outer diameter of the end cap and the outer diameter of the glass lamp tube should have a difference therebetween with an average tolerance of up to +/−0.2 mm, with the maximum tolerance up to +/−1 mm. Due to the substantial aligning of the center line of the end cap and the center line of the glass lamp tube combined with the fact that the width/outer diameter of the end cap and the outer diameter of the glass lamp tube (in the middle region of the lamp tube, but not including the two narrowly curved end regions at the ends thereof) are substantially equal, so that the entire LED tube lamp (assembly) appears to have an integrated planar flat surface. As a result, during shipping or transport of the LED tube lamp, the shipping packaging support or bracket would not just only make direct contact with the end caps, but also the entire LED tube lamp, including the glass lamp tube, thus entire span or length of the LED tube lamp serves or functions as being multiple load/stress points, which thereby distribute the load/stress more evenly over a wider surface, and can lead to lesser risks for breakage of the glass lamp tube.

The present invention provides the hot melt adhesive (includes a so-called commonly known as "welding mud powder") included in the LED tube lamp to have the following material compositions: phenolic resin 2127, shellac, rosin, calcium carbonate powder, zinc oxide, and ethanol.

To solve at least one of the above problems, the present invention provides a LED tube lamp having a magnetic metal member disposed between an end cap and the end of a lamp tube thereof.

To solve at least one of the above problems, the present invention provides the end cap, configured to be attached over an end of the lamp tube, comprising an electrically insulating tubular part, sleeving over the end of the lamp tube, and a magnetic object, the magnetic object is disposed between an inner circumferential surface of the electrically insulating tubular part of the end cap and the end of the lamp tube.

The present invention provides that the magnetic object can be a magnetic metal member fixedly disposed on an inner circumferential surface of the electrically insulating tubular part, at least a portion of the magnetic metal member is disposed between the inner circumferential surface of the electrically insulating tubular part and the end of the lamp tube.

In embodiments of the present invention, the magnetic metal member and the end of the lamp tube are adhesively bonded, such as by a hot melt adhesive.

In an embodiment of the present invention, the electrically insulating tubular part further comprises a plurality of protruding portions formed on the inner circumferential direction of the electrically insulating tubular part to be extending inwardly thereof, the protruding portion is disposed between an outer circumferential surface of the magnetic metal member and the inner circumferential surface of the electrically insulating tubular part, thereby forming a gap or space therebetween, a thickness of the protruding portion is less than that of the supporting portion.

In another embodiment of the present invention, an electrically insulating tubular part sleeves over the end of the lamp tube, an inner circumferential surface of the electrically insulating tubular part has a plurality of protruding portions extending inwardly in a radial direction, and a magnetic metal member is fixedly disposed in the end cap, the protruding portions of the electrically insulating tubular part are disposed between an outer circumferential surface of the magnetic metal member and an inner circumferential surface of the electrically insulating tubular part, wherein the magnetic metal member is at least partially disposed between an inside surface of the protruding portions of the electrically insulating tubular part and the end of the lamp tube, the protruding portions are to form a plurality of gaps between the outer circumferential surface of the magnetic metal member and the inner circumferential surface of the electrically insulating tubular part, and the protruding portions are equally and spatially arranged along the inner circumferential surface of the electrically insulating tubular part, meanwhile the gaps and the protruding portions are staggeredly arranged.

To solve at least one of the above problems, the present invention provides a LED tube lamp having a lamp tube and an end cap, in which the end cap includes an electrically insulating tubular part and a thermal conductive ring, the electrically insulating tubular part has a first tubular part and a second tubular part, the first tubular part is connected to the second tubular part along an axial direction of the lamp tube, an outer diameter of the second tubular part is less than an outer diameter of the first tubular part, the thermal conductive ring sleeves over the second tubular part, whereby an outer surface of the thermal conductive ring and an outer circumferential surface of the first tubular part are substantially flush with each other. The thermal conductive ring can be a metal ring.

The present invention provides a hot melt adhesive to bond together the end cap and the lamp tube, thus allowing for realization of manufacturing automation for LED tube lights. The thermal conductive ring is adhesively bonded to the lamp tube by the hot melt adhesive. In addition, the thermal conductive ring is fixedly arranged on a circumferential surface of the electrically insulating tubular part. An inner surface of the second tubular part, the inner surface of the thermal conductive ring, the outer surface of the rear end region and the outer surface of the transition region together form an accommodation space in which the hot melt adhesive is disposed in the accommodation space, such as only partially filing thereof. Portion of the hot melt adhesive is disposed between the inner surface of the second tubular part and the outer surface of the rear end region. Upon filling and curing of the hot melt adhesive, the thermal conductive ring is bonded to an outer surface of the lamp tube by the hot melt adhesive therebetween at a first location. Upon filling and curing of the hot melt adhesive, the second tubular part is bonded to the rear end region of the lamp tube by the hot melt adhesive therebetween at a second location. Due to the difference in height between the outer surface of the rear end region and the outer surface of the main region of the lamp tube and the presence and location of the thermal conductive ring in relation to the transition region and the main region of the lamp tube, overflow or spillover of the hot melt adhesive to the main region of the lamp tube can be avoided, forsaking or avoiding having to perform manual adhesive wipe off or clean off, thus improving LED tube lamp production efficiency.

In a preferred embodiment, the lamp tube can be a transparent glass tube, or a glass tube with coated adhesive film on the inner walls thereof. In another embodiment, an end of the second tubular part located away from the first tubular part includes a plurality of notches, the notches are spatially arranged along a circumferential direction of the second tubular part.

In several of the embodiments, due to the substantial aligning of the center line of the end cap and the center line of the glass lamp tube, the width/outer diameter of the end cap, including the thermal conductive ring and the first tubular part, are substantially equal, so that the entire LED tube lamp (assembly) appears to have an integrated planar flat surface.

To solve at least one or more of the above problems, the present invention provides a LED tube lamp having a plurality of LED lead frames in which a plurality of LED chips are disposed therein, respectively.

The present invention provides an LED tube lamp that includes a plurality of LED light sources and a plurality of LED lead frames.

The present invention provides an LED tube lamp that includes a lamp tube and a plurality of LED light sources, disposed inside the lamp tube. Each of the LED light sources comprises an LED lead frame and an LED chip. The LED lead frame has two first sidewalls, two second sidewalls and a recess. The LED chip is disposed in the recess. A height of the first sidewall is lower than a height of the second sidewall.

In one embodiment, the first sidewalls of the LED lead frame are arranged along a length direction of the lamp tube, the second sidewalls of the LED lead frame are arranged along a width direction of the lamp tube.

In another embodiment, each of the first sidewalls of the LED lead frame is extending along the width direction of the lamp tube, each of the second sidewalls of the LED lead frame is extending along the length direction of the lamp tube.

The present invention provides a LED light bar to be disposed inside the lamp tube and fixed closely to an inner surface of the lamp tube. The LED light sources are mounted within the LED lead frames, respectively, which then together are mounted on the LED light bar, respectively. The LED light sources and the power supply are electrically connected by the LED light bar.

The present invention provides an LED light source, which includes an LED chip and an LED lead frame. The LED lead frame includes a recess, a first sidewall and a second sidewall. The LED chip is disposed in the recess. A height of the first sidewall is lower than a height of the second sidewall.

In an embodiment, an inner surface of the first sidewall is a sloped flat surface that is facing towards outside of the recess.

In another embodiment, an inner surface of the first sidewall is a sloped curved surface that is facing towards outside of the recess.

In an embodiment, the first sidewall of the LED lead frame is configured to have an included angle between the bottom surface of the recess and the inner surface thereof between 105 degrees to 165 degrees.

In a preferred embodiment, the included angle between the bottom surface of the recess and the inner surface of the first sidewall can be between 120 degrees and 150 degrees.

The present invention provides the LED chips mounted and fixed on the LED lead frames, respectively, by a bonding adhesive. The LED chips can be in rectangular shape as a strip with the dimension of the length side to the width side at a ratio range from 2:1 to 10:1, preferably at a ratio range from 2.5:1 to 5:1, and further preferably at a ratio range from 3:1 to 4.5:1.

In an embodiment, the LED tube lamp further includes a reflective film layer, in which the reflective film layer is disposed on two sides of the LED light bar, and is extending along a circumferential direction of the lamp tube. The reflective film layer is occupying 30% to 50% of the inner surface area of the lamp tube.

In various embodiments, the LED tube lamp has the LED light sources therein to be arranged in one or more rows, and each row of the LED light sources is extending along a length direction of the lamp tube.

In an embodiment, the LED lead frames of the LED light sources have all of the second sidewalls thereof disposed in one straight line along the length direction of the lamp tube, respectively.

In another embodiment, the LED light sources are arranged and disposed in more than one rows, and each row of the LED light sources are arranged along the length direction of the lamp tube. The LED lead frames of the LED light sources disposed in the outermost two rows along in the width direction of the lamp tube, the LED lead frames of the LED light sources have all of the second sidewalls thereof disposed in one straight line along the length direction of the lamp tube, respectively. The second sidewalls disposed on a same side of the same row are collinear to one another. The LED lead frame disposed in the outermost two rows to have two first sidewalls configured along the length direction and two second sidewalls configured along the width direction, so that the second sidewalls located at the outermost two rows can block the user's line of sight for directly seeing the LED light sources, the reduction of visual graininess unpleasing effect can thereby be achieved.

One benefit of the LED tube lamp fabricated in accordance with the embodiments of present invention is that as compared to having rigid aluminum plate or FR4 board as the LED light bar, when the lamp tube has been ruptured, the entire lamp tube is still maintaining a straight tube configuration, then the user may be under a false impression the LED tube lamp would remain usable and fully functional. As a result, electric shock can occur upon handling or installation thereof. On the other hand, because of added flexibility and bendability of the bendable circuit sheet for the LED light bar according to embodiments of present invention, the problems faced by the aluminum plate, FR4 board, conventional 3-layered flexible board having inadequate flexibility and bendability are thereby solved. Due to the adopting of the flexible substrate/bendable circuit sheet for the LED light bar of embodiments of present invention, the bendable circuit sheet (the LED light bar) renders a ruptured or broken lamp tube to being not able (unable) to maintain a straight pipe or tube configuration so as to better inform the user that the LED tube lamp is deemed unusable so as to avoid potential electric shock accidents from occurring.

Another benefit of the LED tube lamp fabricated in accordance with the embodiments of present invention is that the bendable circuit sheet (LED light bar) having a freely extending end portion together with the soldered connection between the output terminal of the power supply, and the freely extending end portion can be coiled to be fittingly accommodating inside the lamp tube, so that the freely extending end portions of the bendable circuit sheet can be deformed in shape due to contracting or curling up to fit inside the lamp tube, and when using a solder bonding technique having a pad of the power supply being of different surface to one of the surfaces of the bendable circuit sheet that is mounted with the LED light sources, a downward tension is exerted on the power supply at the connection end of the power supply and the bendable circuit sheet, so that the bendable circuit sheet with through-holes configured bond pad would form a stronger and more secure electrical connection between the bendable circuit sheet and the power supply. Another benefit of the LED tube lamp fabricated in accordance with the embodiments of present invention is that the bendable circuit sheet allows for soldering for forming solder joints between the flexible substrate and the power supply, and the bendable circuit sheet can be used to pass through the transition region and soldering bonded to the output terminal of the power supply for providing electrical coupling to the power supply, so as to avoid the usage of bonding wires, and improving upon the reliability thereof.

Another benefit of the LED tube lamp fabricated in accordance with the embodiment of present invention is that the lamp tube having the diffusion film layer coated and bonded to the inner wall thereof allows the light outputted or emitted from the LED light sources to be more uniformly transmitted through the diffusion film layer and then through the lamp tube. In other words, the diffusion film layer provides an improved illumination distribution uniformity of the light outputted by the LED light sources so as to avoid the formation of dark regions seen inside the illuminated or lit up lamp tube.

Another benefit of the LED tube lamp fabricated in accordance with the embodiment of present invention is that the applying of the diffusion film layer made of optical diffusion coating material to outer surface of the rear end region along with the hot melt adhesive would generate increased friction resistance between the end cap and the lamp tube due to the presence of the optical diffusion coating (when compared to that of an example that is without any optical diffusion coating), which is beneficial for preventing accidental detachment of the end cap from the lamp tube. In addition, using this optical diffusion coating material for forming the diffusion film layer, a superior light transmittance ratio of about 85%-96% can be achieved.

Another benefit of the LED tube light fabricated in accordance with the embodiments of present invention is that the diffusion film layer can also provide electrical isolation for reducing risk of electric shock to a user upon breakage of the lamp tube. Meanwhile, in some embodiment, the particle size of the reflective material such as strontium phosphate or barium sulfate will be much larger than the particle size of the calcium carbonate. Therefore, selecting just a small amount of reflective material in the optical diffusion coating can effectively increase the diffusion effect of light.

Another benefit of the LED tube lamp fabricated in accordance with the embodiments of present invention is that the reflective film layer when viewed by a person looking at the lamp tube from the side serve to block the LED light sources, so that the person does not directly see the LED light sources, thereby reducing the visual graininess effect. Meanwhile, reflection light passes through the reflective film layer emitted from the LED light source, can control the divergence angle of the LED tube lamp, so that more light is emitted in the direction that has been coated with the reflective film, such that the LED tube lamp has higher energy efficiency when providing same level of illumination performance. Preferably, reflectance at more than 95% can also be achievable.

Another benefit of the LED tube lamp fabricated in accordance with the embodiments of present invention is that the glass lamp tube containing an adhesive film layer would allow the broken glass pieces to be adhere together even upon breakage thereof, without forming shattered openings, thus can preventing accidental electrical shock caused by physical contact of the internal electrical conducting elements residing inside the glass lamp tube by someone, at the same time, through having the adhesive film layer of this type of material composition, would also include light diffusing and light transmitting properties, so as to achieve more evenly distributed LED lamp tube illumination, and higher light transmittance. In an embodiment, the glass lamp tube is coated with the adhesive film layer on its inside wall surface, the adhesive film layer is made primarily of calcium carbonate, along with a thickening agent, ceramic activated carbon, and deionized water, which are mixed and combined together to be evenly coated on the side wall surface of the glass tube, with average thickness of 20~30 micron meters, which can lead to about 85%-96% light transmittance ratio. Finally, the deionized water is evaporated, so as to leave behind the calcium carbonate, the thickening agent, and the ceramic activated carbon.

One benefit of the LED tube lamp fabricated in accordance with the embodiment of present invention is that the magnetic metal member is out of sight when viewed by a user of the LED tube lamp, thus the flush surface of the end cap can be more aesthetically pleasing.

Another benefit of the LED tube lamp fabricated in accordance with the embodiment of present invention is that actual curing of the hot melt adhesive by the energized induction coil is performed more uniformly and done more precisely, thus the bonding of the end cap, the magnetic metal member, and the lamp tube are more secure and lasting.

Another benefit of the LED tube lamp fabricated in accordance with the embodiments of present invention is that due to the difference in height between the outer surface of the rear end region and the outer surface of the main region of the lamp tube and the presence and location of the magnetic metal member in relation to the transition region and the main region of the lamp tube, overflow or spillover of the hot melt adhesive to the main region of the lamp tube can be totally avoided, forsaking or avoiding having to perform manual adhesive wipe off or clean off, thus improving LED tube lamp production efficiency.

Another benefit of the LED tube lamp fabricated in accordance with the embodiments of present invention is that due to the substantial aligning of the center line of the end cap and the center line of the glass lamp tube, the outer diameter of the end cap and of lamp tube are substantially equal, so that the entire LED tube lamp (assembly) appears to have an integrated planar flat surface. As a result, during shipping or transport of the LED tube lamp, the shipping packaging support or bracket would not just only make direct contact with the end caps, but also the entire LED tube lamp, including the glass lamp tube, thus entire span or length of the LED tube lamp serves or functions as being multiple load/stress points, which thereby distribute the load/stress more evenly over a wider surface, and can lead to lesser risks for breakage of the glass lamp tube.

One benefit of the LED tube lamp fabricated in accordance with the embodiments of present invention is that when the user is viewing along the width direction toward the lamp tube, the second sidewall can block the line of sight of the user to the LED light source, thus reducing unappealing grainy spots. In addition, the sloped first sidewall also enhances light extraction from the LED light source.

Another benefit of the LED tube lamp fabricated in accordance with the embodiments of present invention is that by having the LED lead frames with the height of the first sidewall being lower than that of the second sidewall, more light emitted from the LED chips can be effectively transmitted along a length direction out of the recesses of the LED lead frames, while lesser light can be transmitted along a width direction out of the recesses thereof.

Meanwhile, yet another benefit of the LED tube lamp fabricated in accordance with the embodiments of present invention is that the LED lead frames serve to protect the LED chips from potential damages.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
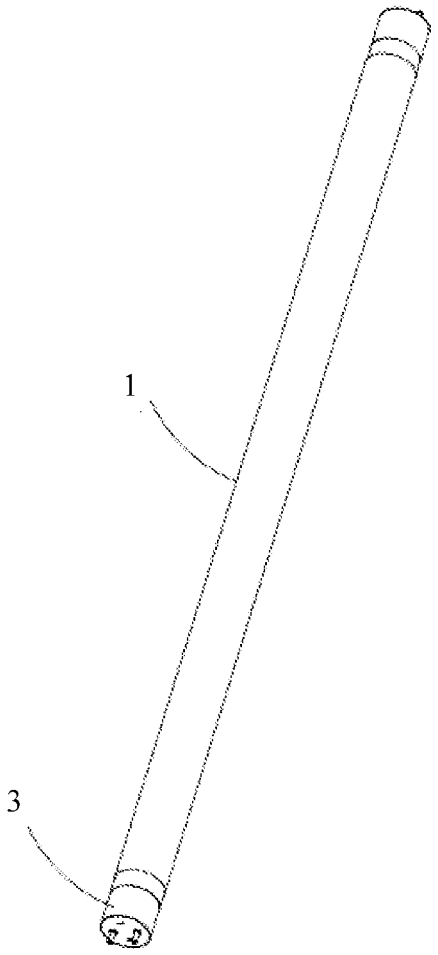
FIG. 1 is a perspective view of an LED tube lamp according to an embodiment of the present invention.
Figure 2:
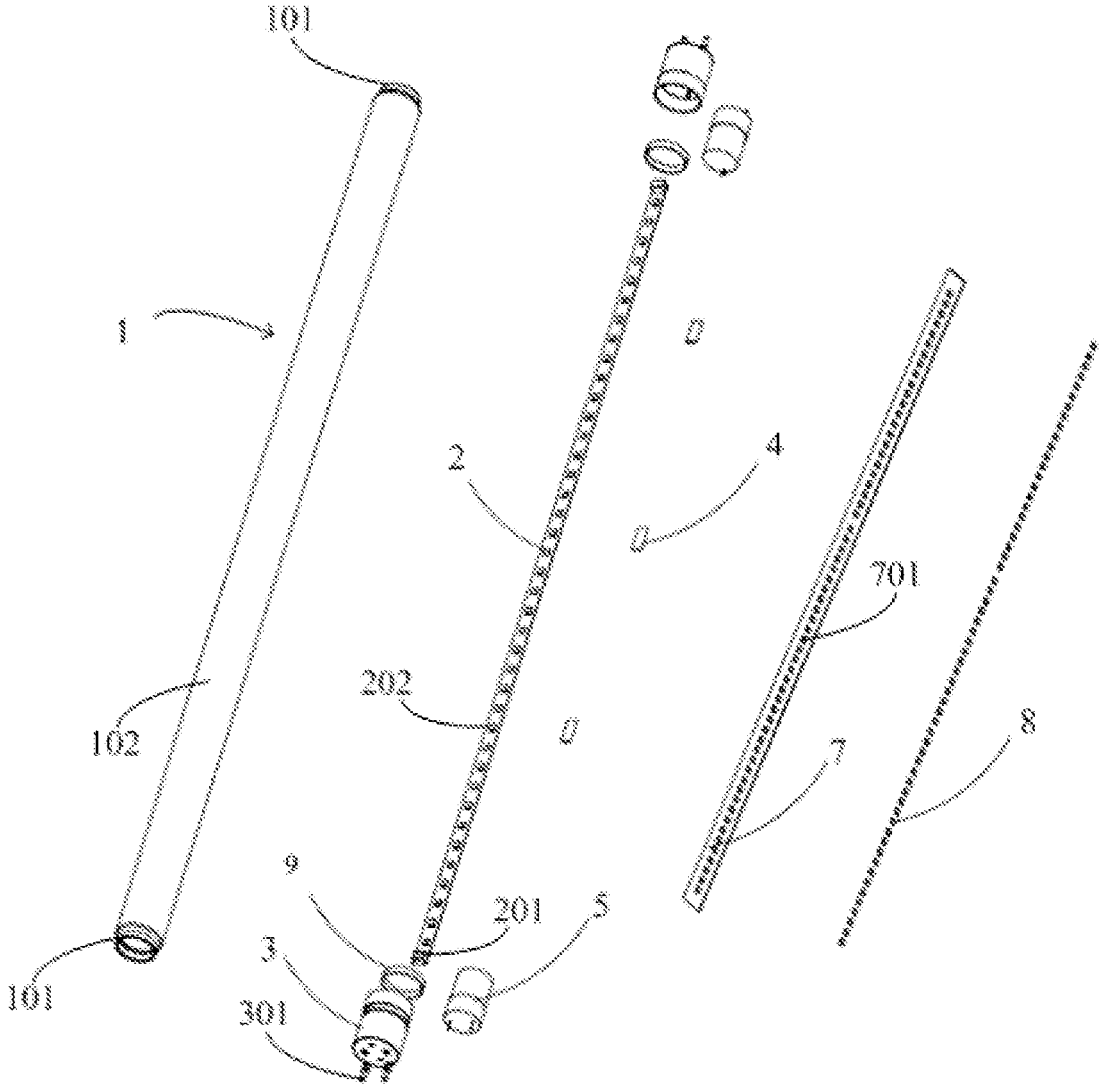
FIG. 2 is an exploded view of a disassembled LED tube lamp according to the embodiment of the present invention.

According to an embodiment of present invention, an LED tube lamp is shown in FIGS. 1 and 2, in which the LED tube lamp includes at least a lamp tube 1, an LED light bar 2, and two end caps 3. The LED light bar 2 is disposed inside the lamp tube 1 when assembled. The two end caps 3 are disposed at the two ends of the lamp tube, respectively. The sizes of the two end caps are different in some embodiments, and the size of one end cap is 30%-80% of the size of the other end cap in some other embodiments. The lamp tube 1 can be made of plastic or glass.

In the present embodiment, the lamp tube 1 is made of tempered glass. The method for strengthening or tempering of glass tube can be done by a chemical tempering method or a physical tempering method for further processing on the glass lamp tube 1. For example, the chemical tempering method is to use other alkali metal ions to exchange with the Na ions or K ions. Other alkali metal ions and the sodium (Na) ions or potassium (K) ions on the glass surface are exchanged, in which an ion exchange layer is formed on the glass surface. When cooled to room temperature, the glass is then under tension on the inside, while under compression on the outside thereof, so as to achieve the purpose of increased strength, including but not limited to the following glass tempering methods: high temperature type ion exchange method, the low temperature type ion exchange method, dealkalization, surface crystallization, sodium silicate strengthening method. High-temperature ion exchange method includes the following steps. First, glass containing sodium oxide ($Na_2O$) or potassium oxide ($K_2O$) in the temperature range of the softening point and glass transition point are inserted into molten salt of lithium, so that the Na ions in the glass are exchanged for Li ions in the molten salt. Later, the glass is then cooled to room temperature, since the surface layer containing Li ions has different expansion coefficient with respect to the inner layer containing Na ions or K ions, thus the surface produces residual stress and is reinforced. Meanwhile, the glass containing $AL_2O_3$, $TiO_2$ and other components, by performing ion exchange, can produce glass crystals of extremely low coefficient of expansion. The crystallized glass surface after cooling produces significant amount of pressure, up to 700 MPa, which can enhance the strength of glass. Low-temperature ion exchange method includes the following steps: First, a monovalent cation (e.g., K ions) undergoes ion exchange with the alkali ions (e.g. Na ion) on the surface layer at a temperature range that is lower than the strain point temperature, so as to allow the K ions penetrating the surface. For example, for manufacturing a $Na_2O+CaO+SiO_2$ system glass, the glass can be impregnated for ten hours at more than four hundred degrees in the molten salt. The low temperature ion exchange method can easily obtain glass of higher strength, and the processing method is simple, does not damage the transparent nature of the glass surface, and not undergo shape distortion. Dealkalization includes of treating glass using platinum (Pt) catalyst along with sulfurous acid gas and water in a high temperature atmosphere. The Na+ ions are migrated out and bleed from the glass surface to be reacted with the Pt catalyst, so that whereby the surface layer becomes a $SiO_2$ enriched layer, which results in being a low expansion glass and produces compressive stress upon cooling. Surface crystallization method and the high temperature type ion exchange method are different, but only the surface layer is treated by heat treatment to form low expansion coefficient microcrystals on the glass surface, thus reinforcing the glass. Sodium silicate glass strengthening method is a tempering method using sodium silicate (water glass) in water solution at 100 degrees Celsius and several atmospheres of pressure treatment, where a stronger/higher strength glass surface that is harder to scratch is thereby produced. The above glass tempering methods described including physical tempering methods and chemical tempering methods, in which various combinations of different tempering methods can also be combined together.

Figure 3:
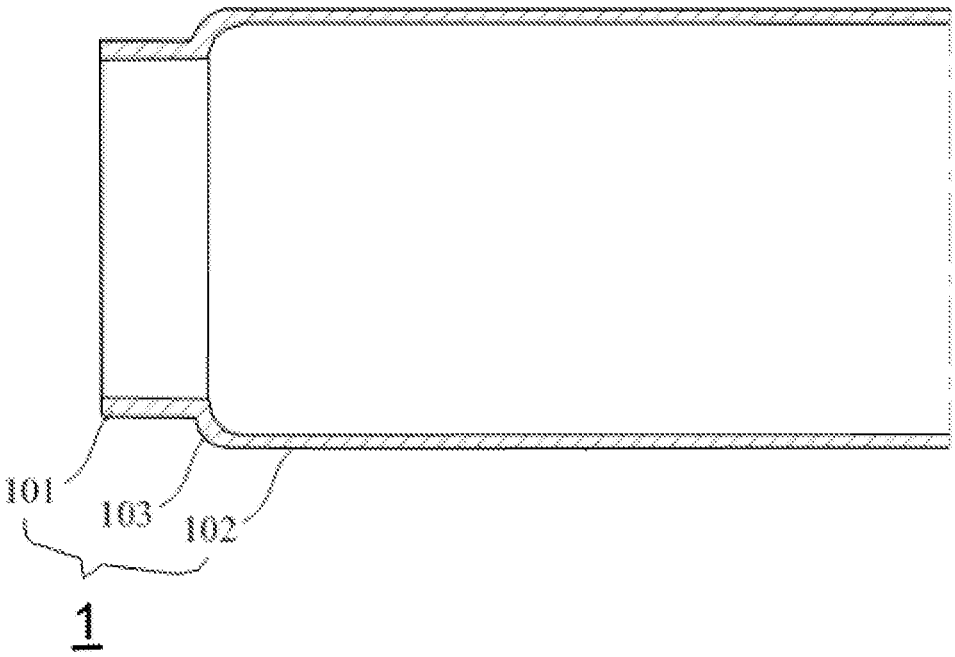
FIG. 3 is a cross-sectional partial view of a lamp tube of the LED tube lamp of the present invention at one end region thereof.
Figure 7:
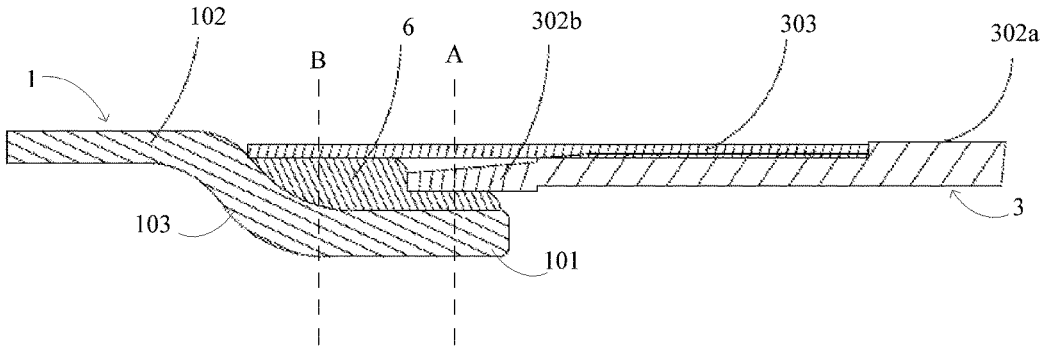
FIG. 7 is a cross-sectional partial view of a connecting region of the end cap and the lamp tube of the embodiment of the present invention.
Figure 9:
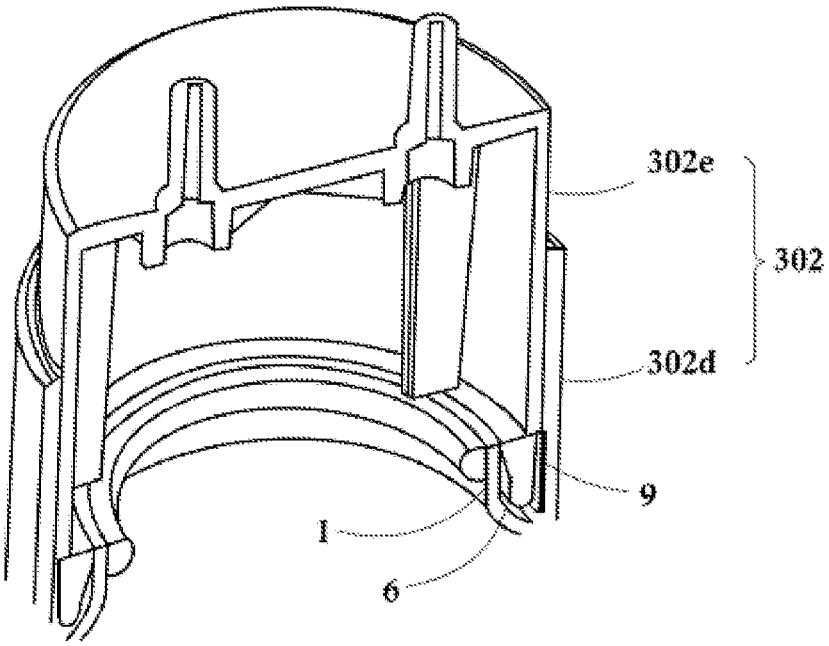
FIG. 9 is a perspective sectional schematic partial view of the all-plastic end cap of FIG. 8 showing internal structure thereof.

In the illustrated embodiment as shown in FIG. 3, the lamp tube 1 includes a main region 102, a plurality of rear end regions 101, and a plurality of transition regions 103. The lamp tube 1 is fabricated by undergoing a glass shaping process so as to form one or more narrowly curved end regions at one or more ends thereof, in which each narrowly curved end region includes one rear end region 101 and one transition region 103, from a cylindrical raw lamp tube. At the same time, the glass shaping process coincides to be substantially concurrently or is same as a glass toughening or tempering treatment process. In other words, while the lamp tube 1 is toughened or tempered, the narrowly curved end regions as shown in FIG. 3 are also shaped alongside at the same time. Each transition region 103 is located between an end of the main region 102 and one rear end region 101. The rear end region 101 is connected to one end of the transition region 103, and the other end of the transition region 103 is connected to one end of the main region 102. In the illustrated embodiment, the number of the rear end regions 101 and the number of the transition regions 103 are two, respectively. The transition region 103 is curved or arc-shaped at both ends thereof under cross-sectional view. As illustrated in FIGS. 7 and 9, one end cap 3 sleeves over the rear end region 101. The outer diameter of the rear end region 101 is less than the outer diameter of the main region 102. After undergone a glass toughening or tempering treatment process, the rear end regions 101 of the lamp tube 1 are formed to be a plurality of toughened glass structural portions. The end cap 3 sleeves over the rear end region 101 (which is a toughened glass structural portion). The outer diameter of the end cap 3 is the same as the outer diameter of the main region 102 of the lamp tube 1.

Figure 4:
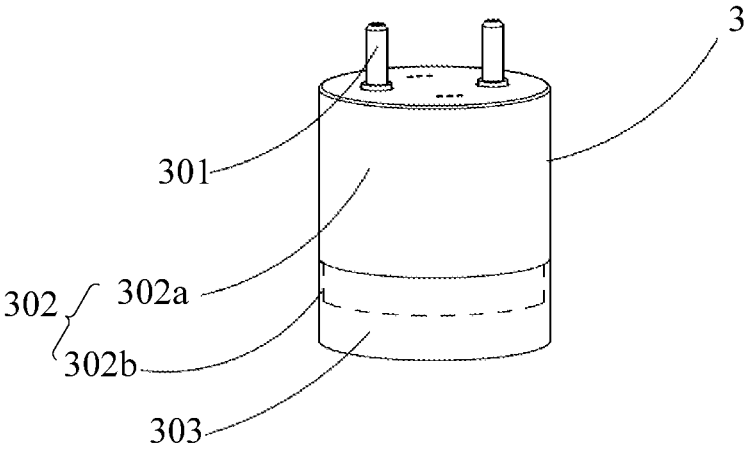
FIG. 4 is a frontal perspective schematic view of an end cap according to the embodiment of the LED tube lamp of the present invention.
Figure 5:
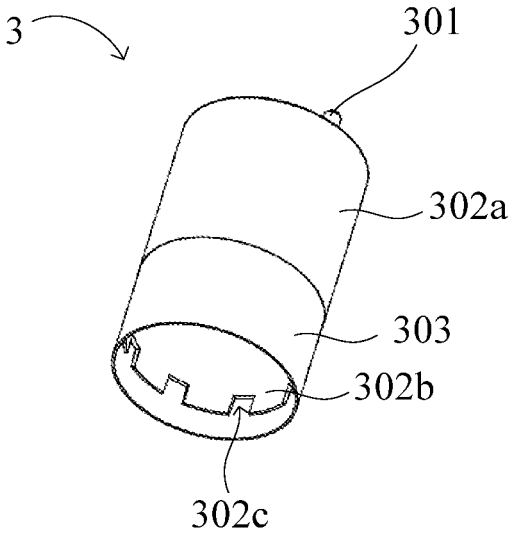
FIG. 5 is a bottom perspective view of another embodiment of the end cap of the present invention, showing the inside structure thereof.
Figure 6:
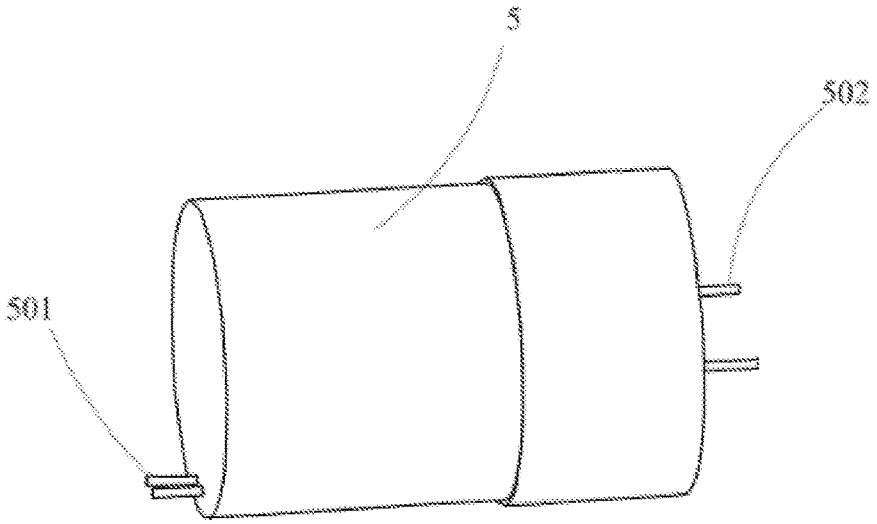
FIG. 6 is a side perspective view of a power supply of the LED tube lamp according to the embodiment of the present invention.

Referring to FIGS. 4 and 5, each end cap 3 includes a plurality of hollow conductive pins 301, an electrically insulating tubular part 302 and a thermal conductive ring 303. The thermal conductive ring 303 can be a metal ring that is tubular in shape. The thermal conductive ring 303 sleeves over the electrically insulating tubular part 302. The hollow conductive pins 301 are disposed on the electrically insulating tubular part 302. As shown in FIG. 7, one end of the thermal conductive ring 303 is protruded away from the electrically insulating tubular part 302 of the end cap 3 towards one end of the lamp tube 1, of which is bonded and adhered using a hot melt adhesive 6. As illustrated, the hot melt adhesive 6 forms a pool and then solidifies to fittingly join together the rear end region 101 and a portion of the transition region 103 of the lamp tube 1 to a portion of the thermal conductive ring 303 and a portion of the electrically insulating tubular part 302 of the end cap 3. As a result, the end cap 3 is then joined to one end of the lamp tube 1 using the hot melt adhesive 6. The thermal conductive ring 303 of the end cap 3 is extending to the transition region 103 of the lamp tube 1. The outer diameter of the thermal conductive ring 303 is substantially the same as the outer diameter of the main region 102 of the lamp tube 1, and the outer diameter of the thermal conductive ring 303 is also substantially the same as the outer diameter of the electrically insulating tubular part 302. The electrically insulating tubular part 302 facing toward the lamp tube 1 and the transition region 103 has a gap therebetween. As a result, the LED tube lamp has a substantially uniform exterior diameter from end to end thereof. Because of the substantially uniform exterior diameter of the LED tube lamp, the LED tube lamp has a uniformly distributed stress point locations covering the entire span of the LED tube lamp (in contrast with conventional LED tube lamps which have different diameters between the end caps 3 and the lamp tube 1, and often utilizes packaging that only contacts the end caps 3 (of larger diameter), but not the lamp tube 1 of reduced diameter). Therefore, the packaging design configured for shipping of the lamp tube 1 of the embodiment of present invention can include more evenly distributed contact stress points at many more locations covering the entire span of the LED tube lamp, up to contacting along the entire outer surface of the LED tube lamp 1.

In the present embodiment, the outer diameter of the end caps 3 are the same as the outer diameter of the main region 102, and the tolerance for the outer diameter measurements thereof are preferred to be within +/−0.2 millimeter (mm), and should not exceed +/−1.0 millimeter(mm). The difference between an outer diameter of the rear end region 101 and the outer diameter of the main region 102 can be 1 mm to 10 mm for typical product applications. Meanwhile, for preferred embodiment, the difference between the outer diameter of the rear end region 101 and the outer diameter of the main region 102 can be 2 mm to 7 mm. The length of the transition region 103 along the axial direction of the lamp tube 1 is between 1 mm to 4 mm. Upon experimentation, it was found that when the length of the transition region 103 along the axial direction of the lamp tube 1 is either less than 1 mm or more than 4 mm, problems would arise due to insufficient strength or reduction in light illumination surface of the lamp tube. In alternative embodiment, the transition region 103 can be without curve or arc in shape. Upon adopting the T8 standard lamp format as an example, the outer diameter of the rear end region 101 is configured between 20.9 mm to 23 mm. Meanwhile, if the outer diameter of the rear end region 101 is less than 20.9 mm, the inner diameter of the rear end region 101 would be too small, thus rendering inability of the power supply to be fittingly inserted into the lamp tube 1. The outer diameter of the main region 102 is preferably configured to be between 25 mm to 28 mm.

Referring to FIG. 2, the LED light bar 2 of the embodiment of the present invention has a plurality of LED light sources 202 mounted thereon. The end cap 3 has a power supply 5 installed therein. The LED light sources 202 and the power supply 5 are electrically connected by the LED light bar 2. The power supply 5 may be in the form of a single individual unit (i.e., all of the power supply components are integrated into one module unit), and to be installed in one end cap 3. Alternatively, the power supply 5 may be divided into two separate units (i.e. all of the power supply components are divided into two parts) which are installed at the end caps 3, respectively. The number of units of the power supply 5 is corresponding to the number of the ends of the lamp tube 1 which had undergone glass tempering and strengthening process. In addition, the location of the power supply is also corresponding to the location of the lamp tube 1 which had undergone glass tempering. The power supply can be fabricated by encapsulation molding by using a high thermal conductivity silica gel (with thermal conductivity≥0.7 w/m·k), or fabricated in the form of exposed power supply electronic components that are packaged by conventional heat shrink sleeved to be placed into the end cap 3. Referring to FIG. 2 and FIGS. 4-6, the power supply 5 includes a male plug 501 and a metal pin 502. The male plug 501 and the metal pin 502 are located at opposite ends of the power supply 5. The LED light bar 2 is configured with a female plug 201 at an end thereof. The end cap 3 is configured with a hollow conductive pin 301 used for coupling with an external power source. The male plugs 501 of the power supply 5 are fittingly engaged into the female plug 201 of the LED light bar 2, while the metal pins 502 of the power supply 5 are fittingly engaged into the hollow conductive pins 301 of the end cap 3. Upon inserting the metal pin 502 into the hollow conductive pin 301, a punching action is provided against the hollow conductive pin 31 using an external punching tool to create a slight amount of shape deformation of the hollow conductive pin 301, thereby securing and fixing the metal pin 502 of the power supply 5. Upon being energized or powered on, the electrical current passes through the hollow conductive pin 301, the metal pin 502, the male plug 501, and the female plug 201, to reach the LED light bar 2, and through the LED light bar 2 to reach the LED light sources 202. In other embodiments, the male plug 501 and the female plug 502 connection structure may not be employed, and conventional wire bonding techniques can be adopted for replacement.

Referring to FIGS. 4-5 and FIGS. 7-9, the end cap 3 sleeves over the lamp tube 1. To be more specific, the end cap 3 sleeves over the rear end region 101 and extending toward the transition region 103 so as to be partially overlapping with the transition region 103. In the present embodiment, the thermal conductive ring 303 of the end cap 3 is extended to reach the transition region 103 of the lamp tube 1, an end of the electrically insulating tubular part 302 facing the lamp tube 1 is not extended to reach the transition region 103, that is to say, the end of the electrically insulating tubular part 302 facing the lamp tube 1 and the transition region 103 has a gap therebetween, In addition, the electrically insulating tubular part 302 is made of a material that is not a good electrical conductor, but is not limited to being plastic or ceramic materials.

The hot melt adhesive 6 (includes a so-called commonly known as "welding mud powder") includes phenolic resin 2127, shellac, rosin, calcium carbonate powder, zinc oxide, and ethanol, etc. The lamp tube 1 at the rear end region 101 and the transition region 103 (as shown in FIG. 7) is coated by the hot melt adhesive, which when undergone heating, would be greatly expanded, so as to allow tighter and closer contact between the end cap 3 and the lamp tube 1, thus allowing for realization of manufacturing automation for LED tube lamp. Furthermore, the hot melt adhesive 6 would not be afraid of decreased reliability when operating under elevated temperature conditions by the power supply and other heat generating components. In addition, the hot melt adhesive 6 can prevent the deterioration of bond strength over time between the lamp tube 1 and the end cap 3, thereby improving long term reliability. Specifically, the hot melt adhesive 6 is filled in between an inner surface portion of the extending portion of the thermal conductive ring 303 and the outer peripheral surface of the lamp tube 1 at the rear end region 101 and the transition region 103 (location is shown in a broken/dashed line identified as "B" in FIG. 7, also referred to as "a first location"). The coating thickness of the hot melt adhesive 6 can be 0.2 mm to 0.5 mm. After curing, the hot melt adhesive 6 expands and contacts with the lamp tube 1, thus fixing the end cap 3 to the lamp tube 1. Thus, upon filling and curing of the hot melt adhesive 6, the thermal conductive ring 303 is caused to be bonded or fixedly arranged to an outer (circumferential) surface of the lamp tube 1 by the hot melt adhesive 6 therebetween at the dashed line B in FIG. 7, which can also be referred to as the first location herein. Due to the difference in height between the outer surface of the rear end region 101 and the outer surface of the main region 102, thus avoiding overflow or spillover of the hot melt adhesive 6 to the main region 102 of the lamp tube 1, forsaking or avoiding having to perform manual adhesive wipe off or clean off, thus improving LED tube lamp production efficiency. Meanwhile, likewise for the embodiment shown in FIG. 9, a magnetic metal member 9 is fixedly arranged or disposed on an inner circumferential surface of the electrically insulating tubular part 302, and bonded to an outer peripheral surface of the lamp tube 1 using the hot melt adhesive 6, in which the hot melt adhesive 6 does not spillover through the gap between the end cap and one of the transition regions 103 during the filling process of the hot melt adhesive 6. During fabrication process of the LED tube lamp, a thermal generating equipment is used to heat up the thermal conductive ring 303, and also heat up the hot melt adhesive 6, to thereby melt and expand thereof to securely attach and bond the end cap 3 to the lamp tube 1.

In the present embodiment, the electrically insulating tubular part 302 of the end cap 3 includes a first tubular part 302*a* and a second tubular part 302*b*. The first tubular part 302*a* and the second tubular part 302*b* are connected along an axis of extension of the electrically insulating tubular part 302 or an axial direction of the lamp tube 1. The outer diameter of the second tubular part 302*b* is less than the outer diameter of the first tubular part 302*a*. The outer diameter difference between the first tubular part 302*a* and the second tubular part 302*b* is between 0.15 mm to 0.30 mm. The thermal conductive ring 303 is fixedly configured over and surrounding the outer circumferential surface of the second tubular part 302*b*. The outer surface of the thermal conductive ring 303 is coplanar or substantially flush with respect to the outer circumferential surface of the first tubular part 302*a*, in other words, the thermal conductive ring 303 and the first tubular part 302*a* have substantially uniform exterior diameters from end to end. As a result, the end cap 3 achieves an outer appearance of smooth and substantially uniform tubular structure. In the embodiment, ratio of the length of the thermal conductive ring 303 along the axial direction of the end cap 3 with respect to the axial length of the electrically insulating tubular part 302 is from 1:2.5 to 1:5. In the present embodiment, the inner surface of the second tubular part 302*b* and the inner surface of the thermal conductive ring 303, the outer surface of the rear end region 101 and the outer surface of the transition region 103 together form an accommodation space. In order to ensure bonding longevity using the hot melt adhesive, in the present embodiment, the second tubular part 302*b* is at least partially disposed around the lamp tube 1, the hot melt adhesive 6 is at least partially filled in an overlapped region (shown by a broken/dashed line identified as "A" in FIG. 7, also referred herein as "a second location") between the inner surface of the second tubular part 302*b* and the outer surface of the rear end region 101 of the lamp tube 1, in which the second tubular part 302*b* and the rear end region 101 of the lamp tube 1 are bonded by the hot melt adhesive 6 disposed therebetween. During manufacturing of the LED tube lamp, when the hot melt adhesive 6 is coated and applied between the thermal conductive ring 303 and the rear end region 101, it may be appropriate to increase the amount of hot melt adhesive used, such that in the subsequent heating process, the hot melt adhesive can be caused to expand and flow in between the second tubular part 302*b* and the rear end region 101, to thereby adhesively bond the second tubular part 302*b* and the rear end region 101. However, in the present embodiment, the hot melt adhesive 6 does not need to completely fill the entire accommodation space (as shown in the illustrated embodiment of FIG. 7), in which a gap is reserved or formed between the thermal conductive ring 303 and the second tubular part 302*b*. Thus, the hot melt adhesive 6 can be only partially filing the accommodation space.

During fabrication of the LED tube lamp, the rear end region 101 of the lamp tube 1 is inserted into one end of the end cap 3, the axial length of the portion of the rear end region 101 of the lamp tube 1 which had been inserted into the end cap 3 accounts for one-third (⅓) to two-thirds (⅔) of the total length of the thermal conductive ring 303 in an axial direction thereof. One benefit is that, the hollow conductive pins 301 and the thermal conductive ring 303 have sufficient creepage distance therebetween, and thus is not easy to form a short circuit leading to dangerous electric shock to individuals. On the other hand, due to the electrically insulating effect of the electrically insulating tubular part 302, thus the creepage distance between the hollow conductive pin 301 and the thermal conductive ring 303 is increased, and thus less people are likely to obtain electric shock caused by operating and testing under high voltage conditions. In this embodiment, the electrically insulating tube 302 in general state, is not a good conductor of electricity and/or is not used for conducting purposes, but not limited to the use made of plastics, ceramics and other materials. Furthermore, for the hot melt adhesive 6 disposed in the inner surface of the second tubular part 302*b*, due to presence of the second tubular part 302*b* interposed between the hot melt adhesive 6 and the thermal conductive ring 303, therefore the heat conducted from the thermal conductive ring 303 to the hot melt adhesive 6 may be reduced. Thus, referring to FIG. 5, in this another embodiment, the end of the second tubular part 302*b* facing the lamp tube 1 (i.e., away from the first tubular part 302*a* ) is provided a plurality of notches 302c, configured for increasing the contact area of the thermal conductive ring 303 and the hot melt adhesive 6, in order to be more conducive to provide rapid heat conduction from the thermal conductive ring 303 to the hot melt adhesive 6, so as to accelerate the curing of the hot melt adhesive 6. The notches 302c are spatially arranged along a circumferential direction of the second tubular part 302*b*. Meanwhile, when the user touches the thermal conductive ring 303, due to the insulation property of the hot melt adhesive 6 located between the thermal conductive ring 303 and the lamp tube 1, no electrical shock would likely be produced by touching damaged portion of the lamp tube 1.

Figure 8:
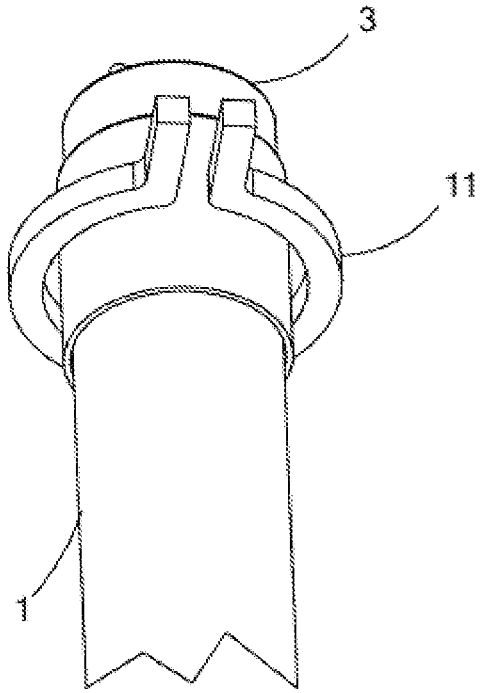
FIG. 8 is perspective illustrative schematic partial view of an all-plastic end cap and the lamp tube being bonded together by an induction coil heat curing process according to another embodiment of the present invention.

The thermal conductive ring 303 can be made of various heat conducting materials, the thermal conductive ring 303 of the present embodiment is a metal sheet, such as aluminum alloy. The second tubular part 302*b* is sleeved with the thermal conductive ring 303 being tubular or ring shaped. The electrically insulating tubular part 302 may be made of electrically insulating material, but would have low thermal conductivity so as to prevent the heat conduction to reach the power supply components located inside the end cap 3, which then negatively affect performance of the power supply components. In this embodiment, the electrically insulating tubular part 302 is a plastic tube. In other embodiments, the thermal conductive ring 303 may also be formed by a plurality of metal plates arranged along a plurality of second tubular part 302*b* in either circumferentially-spaced or not circumferentially-spaced arrangement. In other embodiments, the end cap may take on or have other structures. Referring to FIGS. 8-9, the end cap 3 according to another embodiment includes a magnetic object being of a metal member 9 and an electrically insulating tubular part 302, but not a thermal conductive ring. The magnetic metal member 9 is fixedly arranged on the inner circumferential surface of the electrically insulating tubular part 302, and has overlapping portions with respect to the lamp tube 1 in the radial direction. The hot melt adhesive 6 is coated on the inner surface of the magnetic metal member 9 (the surface of the magnetic metal tube member 9 facing the lamp tube 1), and bonding with the outer peripheral surface of the lamp tube 1. In order to increase the adhesion area, and to improve the stability of the adhesion, the hot melt adhesive 6 can cover the entire inner surface of the magnetic metal member 9. When manufacturing the LED tube lamp of the another embodiment, the electrically insulating tubular part 302 is inserted in an induction coil 11, so that the induction coil 11 and the magnetic metal member 9 are disposed opposite (or adjacent) to one another along the radial extending direction of the electrically insulating tubular part 302. A method for bonding the end cap 3 and the lamp tube 1 with the magnetic metal member 9 according to a second embodiment includes the following steps. The induction coil 11 is energized. After the induction coil 11 is energized, the induction coil 11 forms an electromagnetic field, and the electromagnetic field upon contacting the magnetic metal member 9 then transform into an electrical current, so that the magnetic metal member 9 becomes heated. Then, the heat from the magnetic metal member 9 is transferred to the hot melt adhesive 6, thus curing the hot melt adhesive 6 so as to bond the end cap 3 with the lamp tube 1. The induction coil 11 and the electrically insulating tubular part 302 are coaxially aligned, so that the energy transfer is more uniform. In this embodiment, a deviation value between the axes of the induction coil 11 and the electrically insulating tubular part 302 is not more than 0.05 mm. When the bonding process is complete, the induction coil 11 is removed away from the lamp tube 1. The electrically insulating tubular part 302 is further divide into two portions, namely a first tubular part 302d and a second tubular part 302*e*. In order to provide better support of the magnetic metal member 9, an inner diameter of the first tubular part 302d at the inner circumferential surface of the electrically insulating tubular part 302, for supporting the magnetic metal member 9, is larger than the inside diameter of the second tubular part 302*e*, and a stepped structure is formed by the electrically insulating tubular part 302 and the second tubular part 302*e*, where an end of the magnetic metal member 9 as viewed in an axial direction is abutted against the stepped structure. An inside diameter of the magnetic metal member 9 is larger than an outer diameter of the end (which is the rear end region 101) of the lamp tube 1. Upon installation of the magnetic metal member 9, the entire inner surface of the end cap 3 is maintained flush. Additionally, the magnetic metal member 9 may be of various shapes, e.g., a sheet-like or tubular-like structures being circumferentially arranged or the like, where the magnetic metal member 9 is coaxially arranged with the electrically insulating tubular part 302. In other embodiments, the manufacturing process for bonding the end cap 3 and the lamp tube 1 can be achieved without the magnetic metal member 9. The magnetic substance such as iron powder, nickel powder or iron-nickel powder (being made of iron, nickel, or iron-nickel alloy) is directly mixed in the hot melt adhesive 6. When manufacturing the LED tube lamp of the embodiment, the hot melt adhesive 6 is contained between the inner circumferential surface of the electrically insulating tubular part 302 of the end cap 3 and the end of the lamp tube 1. After the induction coil 11 is energized, the induction coil 11 forms an electromagnetic field, and the charged particles of the magnetic object become heated. Then, the heat generated from the charged particles of the magnetic object is transferred to the hot melt adhesive 6, thus curing the hot melt adhesive 6 so as to bond the end cap 3 with the lamp tube 1.

In other embodiments, the end cap 3 can also be made of all-metal, which requires to further provide an electrically insulating member beneath the hollow conductive pins as safety feature for accommodating high voltage usage.

Figure 16:
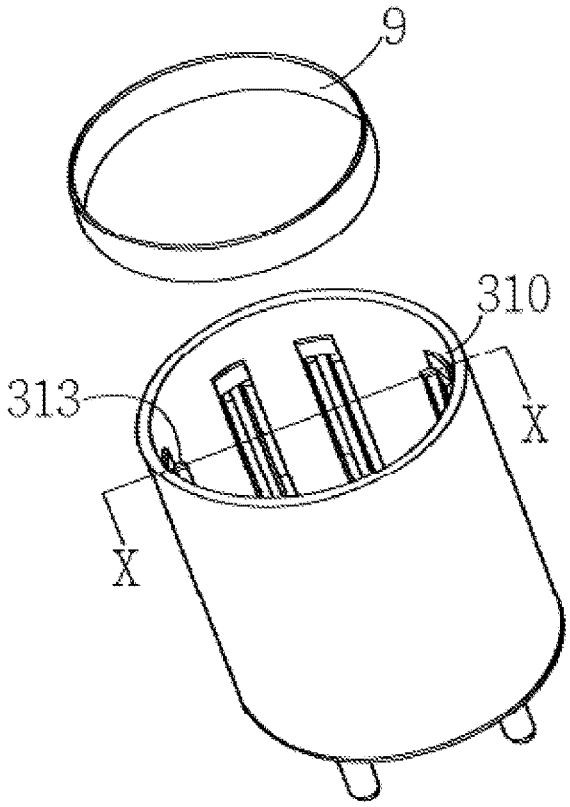
FIG. 16 is an exploded partial perspective view of the electrically insulating tubular part of the end cap according to another embodiment of the present invention, showing a supporting portion and a protruding portion disposed on the inner surface thereof.
Figure 17:
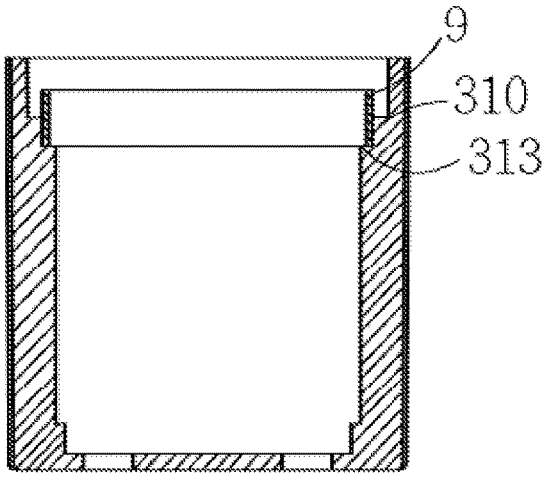
FIG. 17 is a cross-sectional view of the electrically insulating tubular part and the magnetic metal member of the end cap of FIG. 16 taken along a line X-X.
Figure 18:
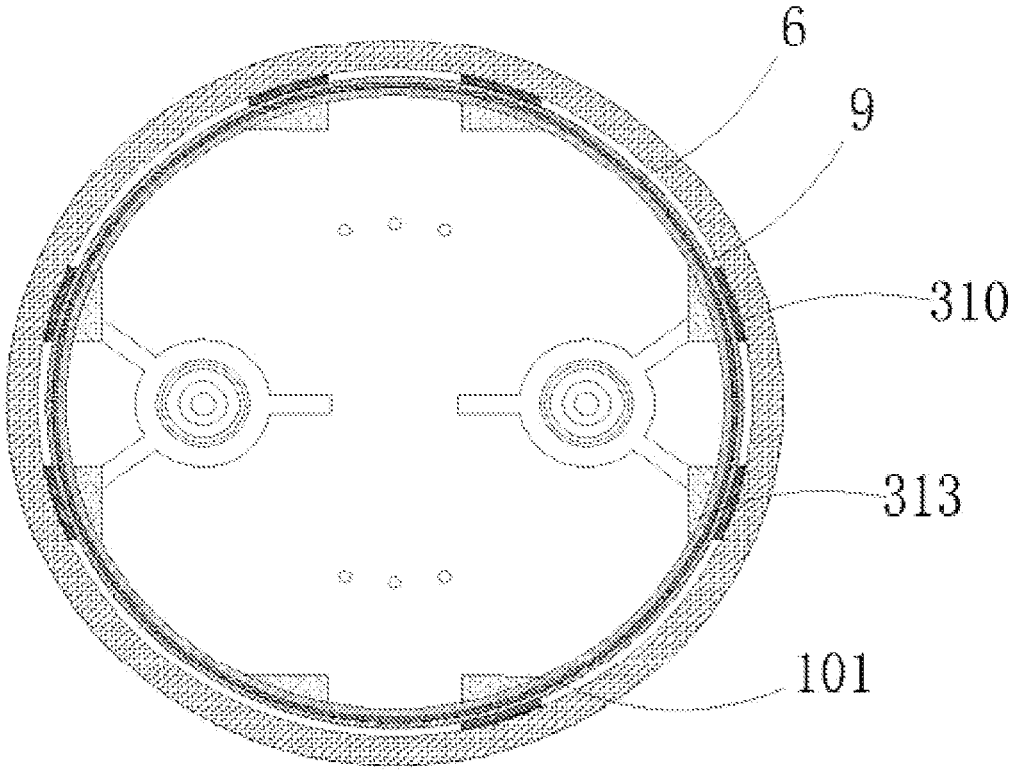
FIG. 18 is a top sectional view of the end cap shown in FIG. 16, showing the electrically insulating tubular part and the lamp tube extending along a radial axis of the lamp tube.
Figure 19:
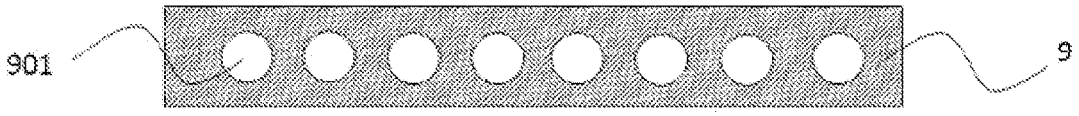
FIG. 19 is a schematic diagram showing the structure of the magnetic metal member including at least one hole, upon flattening out the magnetic metal member to be extending in a horizontal plane.
Figure 20:
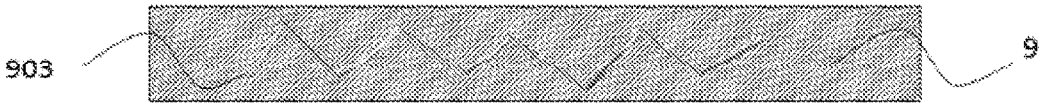
FIG. 20 is a schematic diagram showing the structure of the magnetic metal member including at least one embossed structure, upon flattening out the magnetic metal member to be extending in a horizontal plane.
Figure 21:
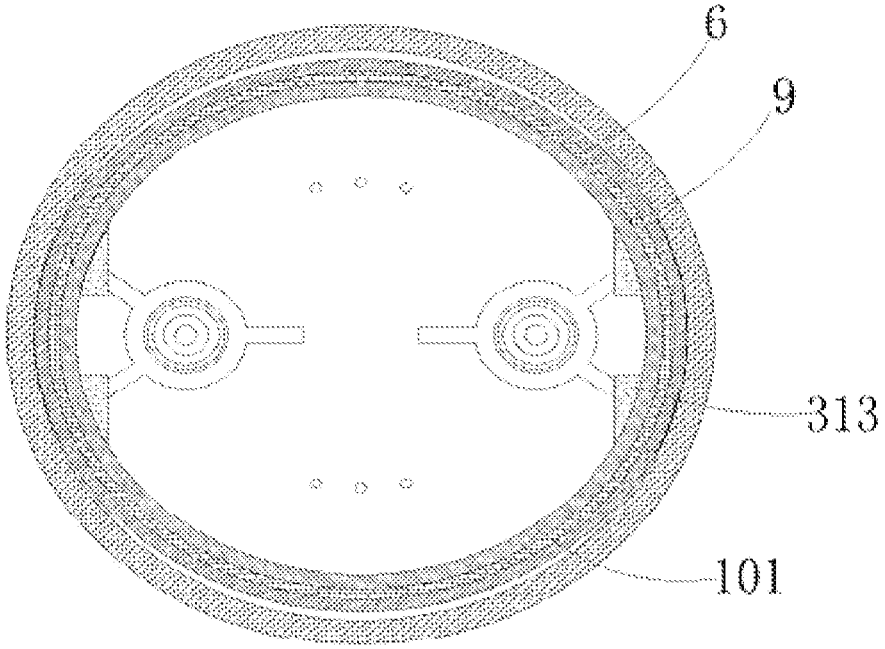
FIG. 21 is a top cross-sectional view of another preferred embodiment of the end cap according to the present invention, showing an electrically insulating tubular part in an elliptical or oval shape extending along a radial axis of the lamp tube which also has a corresponding elliptical or oval shape.

In other embodiments, the magnetic metal member 9 can have at least one opening 901 as shown in FIG. 19, in which the openings 901 can be circular, but not limited to being circular in shape, such as, for example, oval, square, star shaped, etc., as long as being possible to reduce the contact area between the magnetic metal member 9 and the inner peripheral surface of the electrically insulating tubular part 302, but while maintaining the function of melting and curing the hot melt adhesive 6. Preferably, the openings 901 occupy 10% to 50% of the area of the magnetic metal member 9. The opening 901 can be arranged circumferentially around the magnetic metal member 9 in an equidistantly spaced or not equally spaced manner. In other embodiments, the magnetic metal member 9 has an indentation/embossed structure 903 as shown in FIG. 20, in which the embossed structure 903 are formed to be protruding from the inner surface of the magnetic metal member 9 toward the outer surface of the magnetic metal member 9, or vice versa, so long as the contact area between the inner peripheral surface of the electrically insulating tubular part 302 and the outer surface of the magnetic metal member 9 is reduced, but can sustain the function of melting and curing the hot melt adhesive 6. In other embodiments, the magnetic metal member 9 is a non-circular ring, such as, but not limited to an oval ring as shown in FIG. 21. When the lamp tube 1 and the end cap 3 are both circular, the minor axis of the oval ring shape is slightly larger than the outer diameter of the end region of the lamp tube 1, so long as the contact area of the inner peripheral surface of the electrically insulating tubular part 302 and the outer surface of the magnetic metal member 9 is reduced, but can achieve or maintain the function of melting and curing the hot melt adhesive 6. When the lamp tube 1 and the end cap 3 is circular, non-circular rings can reduce the contact area between the magnetic metal member 9 and the inner peripheral surface of the electrically insulating tubular part, but still can maintain the function of melting and curing hot melt adhesive 6. In other words, the inner surface of the electrically insulating tubular part 302 includes a supporting portion 313, which supports the (non-circular shaped) magnetic metal member 9, so that the contact area between the magnetic metal member 9 and the inner surface of the electrically insulating tubular part 302 is reduced, but still achieve the melting and curing of the hot melt adhesive 6. In other embodiments, the inner circumferential surface of the electrically insulating tubular part 302 has a plurality of supporting portions 313 and a plurality of protruding portions 310, as shown in FIGs.16-18, in which the thickness of the protruding portion 310 is smaller than the thickness of the supporting portion 313. A stepped structure is formed at an upper edge of the supporting portion 313, in which the magnetic metal member 9 is abutted against the upper edges of the supporting portions 313, so that the magnetic metal member 9 can be then securely or firmly mounted within the electrically insulating tubular part 302. At least a portion of the protruding portion 310 is positioned between the inner peripheral surface of the electrically insulating tubular part 302 and the magnetic metal member 9. The arrangement or configuration of the protruding portions 310 may be arranged in a ring configuration in the circumferential direction along the inner circumferential surface of the electrically insulating tubular part 302 at equidistantly spaced or non-equidistantly spaced distances, the contact area of the inner peripheral surface of the electrically insulating tubular part 302 and the outer surface of the magnetic metal member 9 is reduced, but can achieve or maintain the function of melting and curing the hot melt adhesive 6. The protruding thickness of the supporting portion 313 toward the interior of the electrically insulating tubular part 302 is between 1 mm to 2 mm. The thickness of the protruding portion 310 of the electrically insulating tubular part 302 that is disposed on the outer surface of the magnetic metal member 9 is less than the thickness of the supporting portion 313, and the thickness of the protruding portion 310 is between 0.2 mm to 1 mm.

Figure 10:
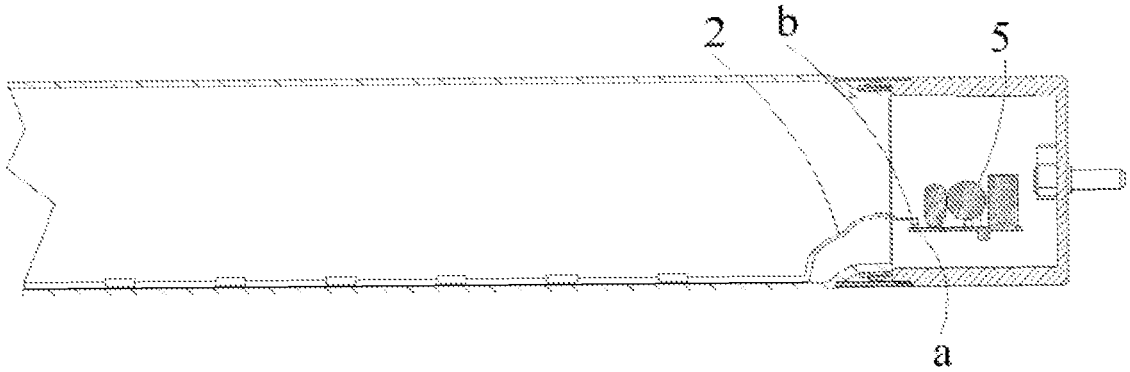
FIG. 10 is a sectional partial view of the connecting region of the lamp tube showing a connecting structure between the LED light bar and the power supply.
Figure 15:
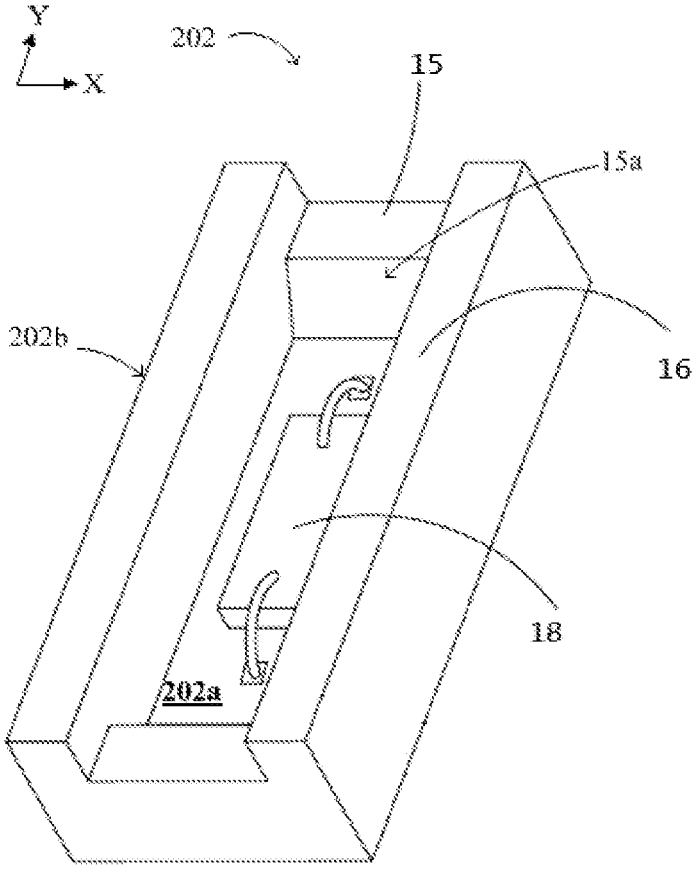
FIG. 15 is a perspective view of an LED lead frame for the LED light sources of the LED tube lamp of the embodiment of the present invention.

Referring again to FIG. 2, the LED tube lamp according to the embodiment of present invention also includes an adhesive sheet 4, an insulation adhesive sheet 7, and an optical adhesive sheet 8. The LED light bar 2 is bonded onto the inner circumferential surface of the lamp tube 1 by using the adhesive sheet 4. In the illustrated embodiment, the adhesive sheet 4 may be silicone adhesive, but is not limited thereto. The insulation adhesive sheet 7 is coated on the surface of the LED light bar 2 facing the LED light sources 202, so that the LED light bar 2 is not exposed, thus electrically insulating the LED light bar 2 and the outside environment. During application of the adhesive sheet, a plurality of through holes 701 are reserved and set aside corresponding to the positions/locations of the LED light sources 202. The LED light sources 202 are mounted in the through holes 701. The material composition of the insulation adhesive sheet 7 comprises vinyl silicone, hydrogen polysiloxane and aluminum oxide. The insulation adhesive sheet 7 has a thickness range of 100 μm to 140 μm (micron meters). If less than 100 μm in thickness, the insulation adhesive sheet 7 will not achieve sufficient electrically insulating effect, but if more than 140 μm in thickness, the excessive insulation adhesive will result in material waste. An optical adhesive sheet 8 is applied or coated on the surface of the LED light source 202. The optical adhesive sheet 8 is a clear or transparent material, in order to ensure optimal light transmission rate. After providing coating application to the LED light sources 202, the shape or structure of the optical adhesive sheet 8 may be in the form of a particulate gel or granular, a strip or a sheet. A preferred range for the refractive index of the optical adhesive sheet 8 is between 1.22 and 1.6. Another embodiment of the optical adhesive sheet 8 can have a refractive index value that is equal to a square root of the refractive index of the housing or casing of the LED light source 202, or equal to plus or minus 15% of the square root of the refractive index of the housing or casing of the LED light source 202, so as to achieve better light transmittance. The housing/casing of the LED light sources 202 is a housing structure to accommodate and carry the LED dies (or chips) such as a LED lead frame 202*b* as shown in FIG. 15. The refractive index range of the optical adhesive sheet 8 in this embodiment is between 1.225 and 1.253. The thickness of the optical adhesive sheet 8 can be in the range of 1.1 mm to 1.3 mm. When assembling the LED light sources to the LED light bar, the optical adhesive sheet 8 is applied on the LED light sources 202; then the insulation adhesive sheet 7 is coated on one side of the LED light bar 2. Then the LED light sources 202 are fixed or mounted on the LED light bar 2. The another side of the LED light bar 2 which is opposite to the side of which the LED light sources 202 are mounted thereon, is bonded and affixed using the adhesive sheet 4 to the inner surface of the lamp tube 1. Later, the end cap 3 is fixed to the end portion of the lamp tube 1, while the LED light sources 202 and the power supply 5 are electrically connected by the LED light bar 2. Alternatively, as shown in FIG. 10, the LED light bar 2 can be used to pass through the transition region 103 for providing electrical coupling to the power supply 5, or traditional wire bonding methods can be adopted to provide the electrical coupling as well. A finished LED tube lamp is then fabricated upon the attachment or joining of the end caps 3 to the lamp tube 1 as shown in FIG. 7 (with the structures shown in FIGS. 4-5), or as shown in FIG. 8 (with the structure of FIG. 9).

In the embodiment, the LED light bar 2 is fixed by the adhesive sheet 4 to an inner circumferential surface of the lamp tube 1, so that the LED light sources 202 are mounted in the inner circumferential surface of the lamp tube 1, which can increase the illumination angle of the LED light sources 202, thereby expanding the viewing angle, so that an excess of 330 degrees viewing angle is possible to achieve. Through the utilization of applying the insulation adhesive sheet 7 on the LED light bar 2 and applying of the optical adhesive sheet 8 on the LED light sources, the electrical insulation of the LED light bar 2 is provided, so that even when the lamp tube 1 is broken, electrical shock does not occur, thereby improving safety.

Furthermore, the LED light bar 2 may be a flexible substrate, an aluminum plate or strip, or a FR4 board, in an alternative embodiment. Since the lamp tube 1 of the embodiment is a glass tube. If the LED light bar 2 adopts rigid aluminum plate or FR4 board, when the lamp tube has been ruptured, e.g., broken into two parts, the entire lamp tube is still able to maintain a straight pipe or tube configuration, then the user may be under a false impression the LED tube lamp can remain usable and fully functional and easy to cause electric shock upon handling or installation thereof. Because of added flexibility and bendability of the flexible substrate for the LED light bar 2, the problem faced by the aluminum plate, FR4 board, conventional 3-layered flexible board having inadequate flexibility and bendability are thereby solved. Due to the adopting of the flexible substrate/bendable circuit sheet for the LED light bar 2 of present embodiment, the LED light bar 2 allows a ruptured or broken lamp tube not to be able to maintain a straight pipe or tube configuration so as to better inform the user that the LED tube lamp is rendered unusable so as to avoid potential electric shock accidents from occurring. The following are further description of the flexible substrate/bendable circuit sheet used as the LED light bar 2. The flexible substrate/bendable circuit sheet and the output terminal of the power supply 5 can be connected by wire bonding, the male plug 501 and the female plug 201, or connected by soldering joint. The method for securing the LED light bar 2 is same as before, one side of the flexible substrate is bonded to the inner surface of the lamp tube 1 by using the adhesive sheet 4, and the two ends of the flexible substrate/bendable circuit sheet can be either bonded (fixed) or not bonded to the inner surface of the lamp tube 1. If the two ends of the flexible substrate are not bonded or fixed to the inner surface of the lamp tube, and also if the wire bonding is used, the bonding wires are prone to be possibly broken apart due to sporadic motions caused by subsequent transport activities as well as being freely to move at the two ends of the flexible substrate/bendable circuit sheet. Therefore, a better option may be by soldering for forming solder joints between the flexible substrate and the power supply. Referring to FIG. 10, the LED light bar 2 in the form of the bendable circuit sheet can be used to pass through the transition region 103 and soldering bonded to the output terminal of the power supply 5 for providing electrical coupling to the power supply 5, so as to avoid the usage of wire bonding, and improving upon the reliability thereof. In the illustrated embodiment, the LED light bar 2 is not fixed to an inner circumferential surface of the lamp tube at two ends thereof. The flexible substrate does not need to have the female plug 201, and the output terminal of the power supply 5 does not need to have the male plug 501. The output terminal of the power supply 5 can have pads a, and leaving behind an amount of tin solder on the pads a, so that the thickness of the tin solder on the pads a are sufficient enough for later forming a solder joint. Likewise, the ends of the bendable circuit sheet can also have pads b, so that the pads a from the output terminal of the power supply 5 are soldered to the pads b of the bendable circuit sheet. In this embodiment, the pads b of the bendable circuit sheet are two separated pads for electrically connecting with the anode and the cathode of the bendable circuit sheet, respectively. In other embodiments, for the sake of achieving scalability and compatibility, the number or quantity of the pads b can be more than two, for example, three, four, or more than four. When the number of pads are three, the third pad can be used for ground pad. When the number of the pads are four, the fourth pad can be used for the signal input terminal. Correspondingly, the pads a and the pads b possess the same number of bond pads. When the number of bond pads is at least three, the bond pads can be arranged in a row or two rows, in accordance with dimensions of actual occupying area, so as to prevent from being too close causing electrical short circuit. In other embodiments, a portion of a printed circuit of the LED light bar can be configured on the bendable printed circuit sheet, the pad b can be a single bond pad. The lesser the number of the bond pads, the easier the fabrication process is to become. On the other hand, the more number of the bond pads, the bendable circuit sheet and the output terminal of the power supply 5 have stronger and more secured electrical connection therebetween. In other embodiments, the inner portion of the bond pad of the pad b can have a plurality of through holes, the pad a can be soldered to the pad b, so that upon soldering, the solder tin can penetrate through the through holes of the pad b. Upon exiting the through holes, the solder tin can be accumulated surrounding the outer periphery of the opening of the through holes, so that upon cooling, a plurality of solder balls, with diameter larger than the diameter of the through holes, are formed. The solder balls possess similar function as nails, so that apart from having the solder tin to secure the pad a and the pad b, the solder balls further act to strengthen the electrical connection of the two pads a, b. In other embodiments, the through holes of the bond pads are disposed at the periphery, that is to say, the bond pad possess a notch, the pad a and the pad b are securely electrically connected via the solder tin extending and filling through the notch, and the excess solder tin would accumulate around the periphery of the openings of the through holes, so that upon cooling, the solder balls with diameter larger than the diameter of the through holes are formed, In the present embodiment, due to the notch structure of the bond pad, the solder tin has the function similar to C-shaped nails. Regardless of whether of forming the through holes of the bond pads before the solder bonding process or during the solder bonding process using the soldering tip directly, the same through holes structure of present embodiment can be formed. The soldering tip and a contacting surface of the solder tin can be a flat, concaved, or convex surface, the convex surface can be a long strip shape or of a grid shape. The convex surface of the solder tin does not completely cover the through holes of the bond pads, so as to ensure that the solder tin can penetrate through the through holes. When the solder tin has accumulated around the periphery of the opening of the through holes, the concaved surface can provide a receiving space for the solder ball. In other embodiments, the bendable circuit sheet has a tooling hole, which can be used to ensure precise positioning of the pad a with respect to the pad b during solder bonding. In the above embodiment, most of the bendable circuit sheet is attached and secured to the inner surface of the lamp tube 1. However, the two ends of the bendable circuit sheet are not secured or fixed to the inner surface of the lamp tube 1, which thereby form a freely extending end portion, respectively. Upon assembling of the LED tube lamp, the freely extending end portion along with the soldered connection between the output terminal of the power supply and itself would be coiled, curled up or deformed to be fittingly accommodating inside the lamp tube 1, so that the freely extending end portions of the bendable circuit sheet are deformed in shape due to being contracted or curled to fit or accommodate inside the lamp tube 1. Using the abovementioned bendable circuit sheet of having the bond pad with through holes, the pad a of the power supply share the same surface with one of the surfaces of the bendable circuit sheet that is mounted with the LED light source. When the freely extending end portions of the bendable circuit sheet are deformed due to contraction or curling up, a lateral tension is exerted on the power supply at the connection end of the power supply and the bendable circuit sheet. In contrast to the solder bonding technique of having the pad a of the power supply being of different surface to one of the surfaces of the bendable circuit sheet that is mounted with the LED light source thereon, a downward tension is exerted on the power supply at the connection end of the power supply and the bendable circuit sheet, so that the bendable circuit sheet, with the through-hole configured bond pad, form a stronger and more secure electrical connection between the bendable circuit sheet and the power supply. If the two ends of the bendable circuit sheet are to be securely fixed to the inner surface of the lamp tube 1, the female plug 201 is mounted on the bendable circuit sheet, and the male plug 501 of the power supply 5 is inserted into the female plug 201, in that order, so as to establish electrical connection therebetween. Direct current (DC) signals are carried on the wiring layer 2*a* of the bendable circuit sheet, unlike the 3-layered conventional flexible substrates for carrying high frequency signals using a dielectric layer. One of the advantage of using the bendable circuit sheet as shown in illustrated embodiment of FIG. 10 over conventional rigid LED light bar is that damages or breakages occurring during the wire bonding of the LED light bar and the power supply through the narrowed curved region of the lamp tube (for conventional rigid LED light bar) is prevented by solder bonding of the bendable circuit sheet and then coiled back into the lamp tube to arrive at proper position inside the lamp tube.

Figure 11:
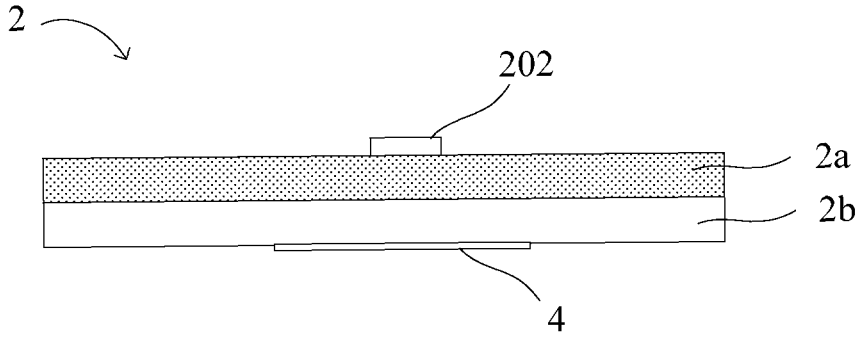
FIG. 11 is a cross-sectional view of a bi-layered flexible substrate of the LED tube lamp of the embodiment of the present invention.

Referring to illustrated embodiment of FIG. 11, the LED light bar 2 is a bendable circuit sheet which includes a wiring layer 2*a* and a dielectric layer 2*b* that are stackingly arranged. The LED light source 202 is disposed on a surface of the wiring layer 2*a* away from the dielectric layer 2*b*. In other words, the dielectric layer 2*b* is disposed on the wiring layer 2*a* away from the LED light sources 202. The wiring layer 2*a* is electrically connected to the power supply 5. Meanwhile, the adhesive sheet 4 is disposed on a surface of the dielectric layer 2*b* away from the wiring layer 2*a* to bond and to fix the dielectric layer 2*b* to the inner circumferential surface of the lamp tube 1. The wiring layer 2*a* can be a metal layer serving as a power supply layer, or can be bonding wires such as copper wire. In alternative embodiment, the LED light bar 2 further includes a circuit protection layer (not shown). In another alternative embodiment, the dielectric layer can be omitted, in which the wiring layer is directly bonded to the inner circumferential surface of the lamp tube. The circuit protection layer can be an ink material, possessing functions as solder resist and optical reflectance. Whether the wiring layer 2*a* is of one-layered, or two-layered structure, the circuit protective layer can be adopted. The circuit protection layer can be disposed on the side/surface of the LED light bar 2, such as the same surface of the wiring layer which has the LED light source 202 disposed thereon. It should be noted that, in the present embodiment, the bendable circuit sheet is a one-layered structure made of just one layer of the wiring layer 2*a*, or a two-layered structure (made of one layer of the wiring layer 2*a* and one layer of the dielectric layer 2*b* ), and thus would be more bendable or flexible to curl than the conventional three-layered flexible substrate. As a result, the bendable circuit sheet (the LED light bar 2) of the present embodiment can be installed in other lamp tube that is of a customized shape or non-linear shape, and the bendable circuit sheet can be mounted touching the sidewall of the lamp tube. The bendable circuit sheet mounted closely to the tube wall is one preferred configuration, and the fewer number of layers thereof, the better the heat dissipation effect, and the lower the material cost. Of course, the bendable circuit sheet is not limited to being one-layered or two-layered structure only, while in other embodiment, the bendable circuit sheet can include multiple layers of the wiring layers 2*a* and multiple layers of the dielectric layers 2*b*, in which the dielectric layers 2*b* and the wiring layers 2*a* are sequentially stacked in a staggered manner, respectively, to be disposed on the surface of the one wiring layer 2*a* that is opposite from the surface of the one wiring layer 2*a* which has the LED light source 202 disposed thereon. The LED light source 202 is disposed on the uppermost layer of the wiring layers 2*a*, and is electrically connected to the power supply 5 through the (uppermost) wiring layer 2*a*. Furthermore, the inner peripheral surface of the lamp tube 1 or the outer circumferential surface thereof is covered with an adhesive film (not shown), for the sake of isolating the inner content from outside content of the lamp tube 1 after the lamp tube 1 has been ruptured. The present embodiment has the adhesive film coated on the inner peripheral surface of the lamp tube 1.

In a preferred embodiment, the lamp tube 1 can be a glass tube with a coated adhesive film on the inner wall thereof (not shown). The coated adhesive film also serves to isolate and segregate the inside and the outside contents of the lamp tube 1 upon being ruptured thereof. The coated adhesive film material includes methyl vinyl silicone oil, hydro silicone oil, Xylene, and calcium carbonate The methyl vinyl silicone oil chemical formula is: $(C_2H_8OSi)n.C_2H_3$. The hydrosilicon oil chemical formula is: $C_3H_9OSi.(CH_4OSi)n.C_3H_9Si$; and the product produced is polydimethylsiloxane (silicone elastomer), which has chemical formula as follow:

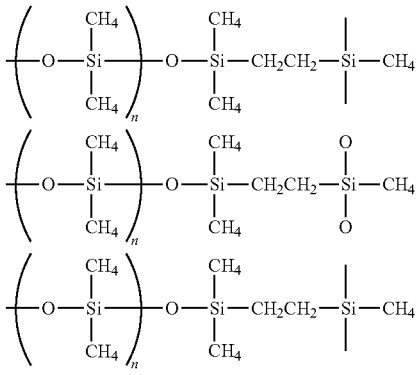

Xylene is used as an auxiliary material. Upon solidifying or hardening of the coated adhesive film when coated on the inner surface of the lamp tube 1, the xylene will be volatilized and removed. The xylene is mainly used for the purpose of adjusting the degree of adhesion or adhesiveness, which can then adjust the thickness of the bonding adhesive. In the present embodiment, the thickness of the coated adhesive film can be between 10 to 800 micron meters (μm), and the preferred thickness of the coated adhesive film can be between 100 to 140 micron meters (μm). This is because the bonding adhesive thickness being less than 100 micron meters, does not have sufficient shatterproof capability for the glass tube, and thus the glass tube is prone to crack or shatter. At above 140 micron meters of bonding adhesive thickness would reduce the light transmittance rate, and also increase material cost. Vinyl silicone oil +hydrosilicone oil allowable ratio range is (19.8-20.2):(20.2-20.6), but if exceeding this allowable ratio range, would thereby negatively affect the adhesiveness or bonding strength. The allowable ratio range for the xylene and calcium carbonate is (2-6):(2-6), and if lesser than the lowest ratio, the light transmittance of the lamp tube will be increased, but grainy spots would be produced or resulted from illumination of the LED lamp tube, negatively affect illumination quality and effect.

If the LED light bar 2 is configured to be a flexible substrate, no coated adhesive film is thereby required.

Figure 12:
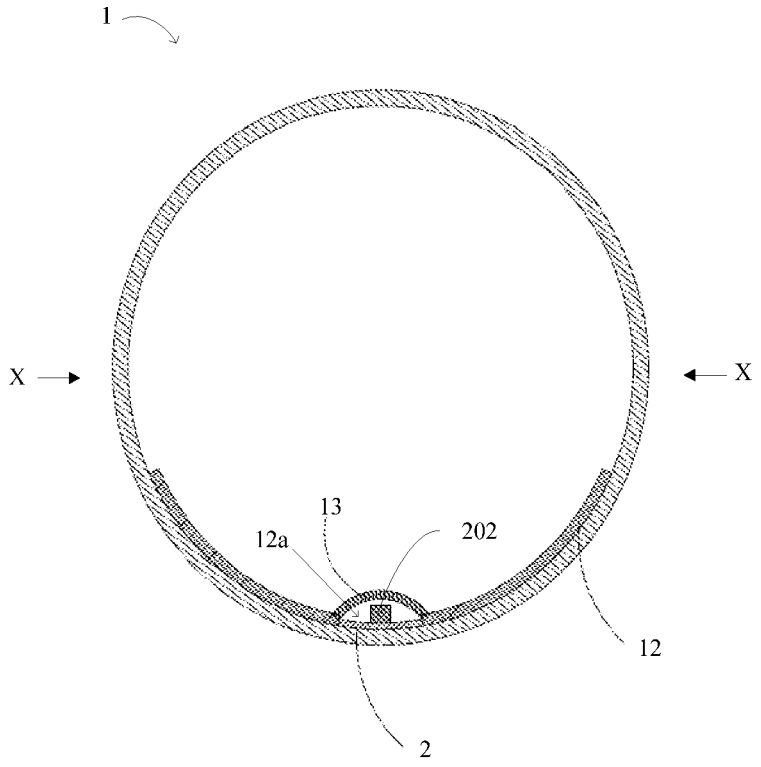
FIG. 12 is an end cross-sectional view of the lamp tube of the LED tube lamp of a first embodiment of present invention as taken along axial direction thereof.

To improve the illumination efficiency of the LED tube lamp, the lamp tube 1 has been modified according to a first embodiment of present invention by having a diffusion film layer 13 coated and bonded to the inner wall thereof as shown in FIG. 12, so that the light outputted or emitted from the LED light sources 202 is transmitted through the diffusion film layer 13 and then through the lamp tube 1. The diffusion film layer 13 allows for improved illumination distribution uniformity of the light outputted by the LED light sources 202. The diffusion film layer 13 can be coated onto different locations, such as onto the inner wall or outer wall of the lamp tube 1 or onto the diffusion coating layer (not shown) at the surface of each LED light source 202, or coated onto a separate membrane cover covering the LED light source 202. The diffusion film layer 13 in the illustrated embodiment of FIG. 12 is a diffusion film that is not in contact with the LED light source 202 (but covering above or over to enshrouding the LED light sources underneath thereof). The diffusion film layer 13 can be an optical diffusion film or sheet, usually made of polystyrene (PS), polymethyl methacrylate (PMMA), polyethylene terephthalate (PET), and/or polycarbonate (PC), in one composite material composition thereof. In alternative embodiment, the diffusion film layer can be an optical diffusion coating, which has a material composition to include at least one of calcium carbonate, halogen calcium phosphate and aluminum oxide that possesses excellent light diffusion and transmittance to exceed 90%. Further, the applying of the diffusion film layer made of optical diffusion coating material to outer surface of the rear end region 101 along with the hot melt adhesive 6 would produce or generate increased friction resistance between the end cap and the lamp tube due to the presence of the optical diffusion coating (when compared to that of an example that is without any optical diffusion coating), which is beneficial for preventing accidental detachment of the end cap from the lamp tube. Composition of the diffusion film layer made by the optical diffusion coating for the alternative embodiment includes calcium carbonate (e.g., CMS-5000, white powder), thickening agents, and a ceramic activated carbon (e.g., ceramic activated carbon SW-C, which is a colorless liquid).

Specifically, average thickness of the diffusion film layer or the optical diffusion coating falls between 20~30 μm after being coated on the inner circumferential surface of the glass tube, where finally the deionized water will be evaporated, leaving behind the calcium carbonate, ceramic activated carbon and the thickener. Using this optical diffusion coating material for forming the diffusion film layer 13, a light transmittance of the diffusion film layer 13 about 90% can be achieved. Generally speaking, the light transmittance ratio of the diffusion film layer 13 is from 85% to 96%. Furthermore, in another possible embodiment, the light transmittance ratio of the diffusion film layer can be 92%-94% while the thickness range is between 200-300 μm which can have other effect. In addition, this diffusion film layer 13 can also provide electrical isolation for reducing risk of electric shock to a user upon breakage of the lamp tube. Furthermore, the diffusion film layer 13 provides an improved illumination distribution uniformity of the light outputted by the LED light sources 202 so as to avoid the formation of dark regions seen inside the illuminated or lit up lamp tube 1. In other embodiments, the optical diffusion coating can also be made of strontium phosphate (or a mixture of calcium carbonate and strontium phosphate) along with a thickening agent, ceramic activated carbon and deionized water, and the coating thickness can be same as that of present embodiment. In another preferred embodiment, the optical diffusion coating material may be calcium carbonate-based material with a small amount of reflective material (such as strontium phosphate or barium sulfate), the thickener, deionizes water and carbon activated ceramic to be coated onto the inner circumferential surface of the glass tube with the average thickness of the optical diffusion coating falls between 20~30 μm. Then, finally the deionized water will be evaporated, leaving behind the calcium carbonate, the reflective material, ceramic activated carbon and the thickener. The diffusion phenomena in microscopic terms, light is reflected by particles. The particle size of the reflective material such as strontium phosphate or barium sulfate will be much larger than the particle size of the calcium carbonate. Therefore, selecting a small amount of reflective material in the optical diffusion coating can effectively increase the diffusion effect of light. In other embodiments, halogen calcium phosphate or aluminum oxide can also be served as the main material for forming the diffusion film layer 13.

Figure 13:
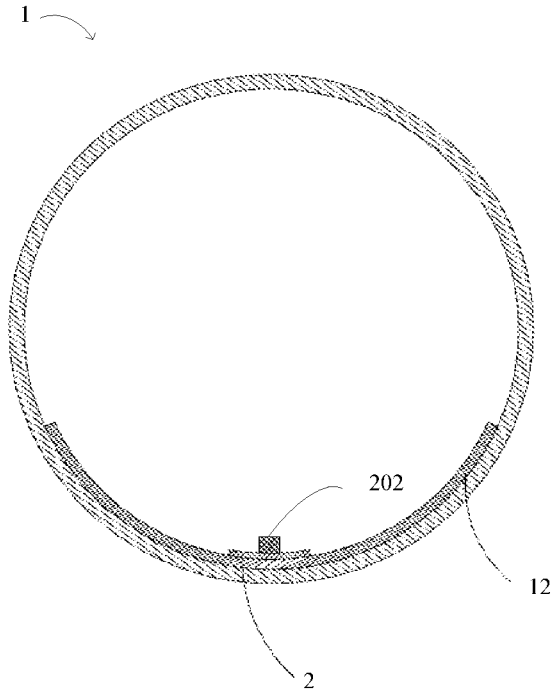
FIG. 13 is an end cross-sectional view of the lamp tube of the LED tube lamp of another embodiment of present invention as taken along axial direction thereof.

Furthermore, as shown in FIG. 12, the inner circumferential surface of the lamp tube 1 is also provided or bonded with a reflective film layer 12, the reflective film layer 12 is provided around the LED light bar 2, and occupy a portion of an area of the inner circumferential surface of the lamp tube 1 arranged along the circumferential direction thereof. As shown in FIG. 12, the reflective film layer 12 is disposed at two sides of the LED light bar 2 extending along a circumferential direction of the lamp tube. The reflective film layer 12 when viewed by a person looking at the lamp tube from the side (in the X-direction shown in FIG. 12) serve to block the LED light sources 202, so that the person does not directly see the LED light sources 202, thereby reducing the visual graininess effect. On the other hand, reflection light passes through the reflective film 12 emitted from the LED light source 202, can control the divergence angle of the LED tube lamp, so that more light is emitted in the direction that has been coated with the reflective film, such that the LED tube lamp has higher energy efficiency when providing same level of illumination performance. Specifically, the reflection film layer 12 provided on the inner peripheral surface of the lamp tube 1, and has a opening 12*a* on the reflective film layer 12 which is configured corresponding to the location of the LED light bar 2, the size of the opening 12*a* is the same or slightly larger than the size of the LED light bar 2. During assembly, the LED light sources 202 are mounted on the LED light bar 2 (or bendable circuit sheet) provided on the inner surface of the lamp tube 1, and then the reflective film layer 12 is adhered to the inner surface of the lamp tube, so that the opening 12*a* of the reflective film layer 12 is matched to the corresponding LED light bar 2 in a one-to-one relationship, and the LED light sources 202 are exposed to the outside of the reflective film layer 12. In the present embodiment, the reflectance of the reflective film layer 12 is at least greater than 85%. Better reflectance of 90% can also be achieved. Meanwhile, more preferably reflectance at more than 95% reflectance can also be achievable, in order to obtain more reflectance. The reflective film layer 12 extends circumferentially along the length of the lamp tube 1 occupying about 30% to 50% of the inner surface area of the lamp tube 1. In other words, extending along a circumferential direction of the lamp tube 1, a circumferential length of the reflective film layer 12 along the inner circumferential surface of the lamp tube 1 and a circumferential length of the inner circumferential surface of the lamp tube 1 has a ratio of 0.3 to 0.5. In the illustrated embodiment of FIG. 12, the reflective film layer 12 is disposed substantially in the middle along a circumferential direction of the lamp tube 1, so that the two distinct portions or sections of the reflective film layer 12 disposed on the two sides of the LED light bar 2 are substantially equal in area. The reflective film layer 12 material may be made of PET or selectively adding some reflective materials such as strontium phosphate or barium sulfate, with a thickness between 140 μm to 350 μm, or between 150 μm to 220 μm for a more preferred embodiment. In other embodiments, the reflective film layer 12 may be provided in other forms, for example, along the circumferential direction of the lamp tube 1 on one or both sides of the LED light source 202, while occupying the same 30% to 50% of the inner surface area of the lamp tube 1. Alternatively, as shown in FIG. 13, the reflective film layer 12 can be without any openings, so that the reflective film layer 12 is directly adhered or mounted to the inner surface of the lamp tube 1 as that of illustrated embodiment, and followed by mounting or fixing the LED light bar 2, with the LED light sources 202 already being mounted thereon, on the reflective film layer 12. In another embodiment, just the reflection film layer 12 may be provided without a diffusion film layer 13 being present, as shown in FIG. 14.

Figure 22:
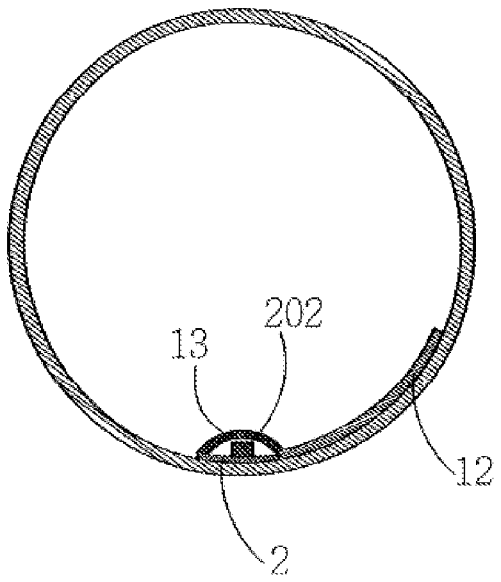
FIG. 22 is an end cross-sectional view of the lamp tube of the LED tube lamp of another embodiment of present invention having a reflective film layer disposed on one side of the LED light bar as taken along axial direction of the lamp tube.
Figure 23:
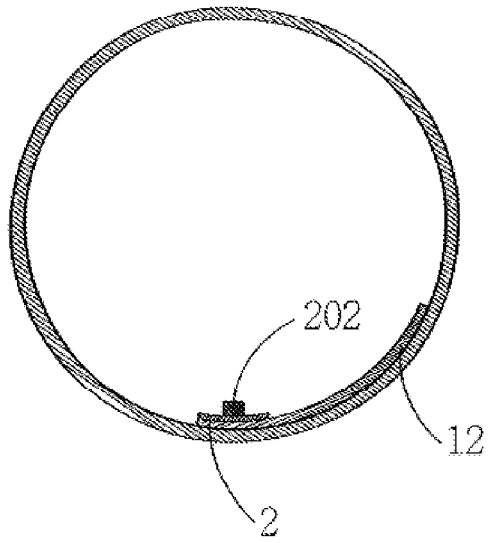
FIG. 23 is an end cross-sectional view of the lamp tube of the LED tube lamp of yet another embodiment of present invention having a reflective film layer disposed under the LED light bar as taken along axial direction of the lamp tube.

In another embodiment, the reflective film layer 12 and the LED light bar 2 are contacted on one side thereof as shown in FIG. 22. In addition, a diffusion film layer 13 is disposed above the LED light bar 2. Referring to FIG. 23, the LED light bar 2 (with the LED light sources 202 mounted thereon) is directly disposed on the reflective film layer 12, and the LED light bar 2 is disposed at an end region of the reflective layer 12 (without having any diffusion layer) of the LED tube lamp of yet another embodiment of present invention.

In other embodiments, the width of the LED light bar 2 (along the circumferential direction of the lamp tube) can be widened to occupy a circumference area of the inner circumferential surface of the lamp tube 1 at a ratio between 0.3 to 0.5, in which the widened portion of the LED light bar 2 can provide reflective effect similar to the reflective film. As described in the above embodiment, the LED light bar 2 may be coated with a circuit protection layer, the circuit protection layer may be an ink material, providing an increased reflective function, with a widened flexible substrate using the LED light sources as starting point to be circumferentially extending, so that the light is more concentrated. In the present embodiment, the circuit protection layer is coated on just the top side of the LED light bar 2 (in other words, being disposed on an outermost layer of the LED light bar 2 (or bendable circuit sheet).

Figure 14:
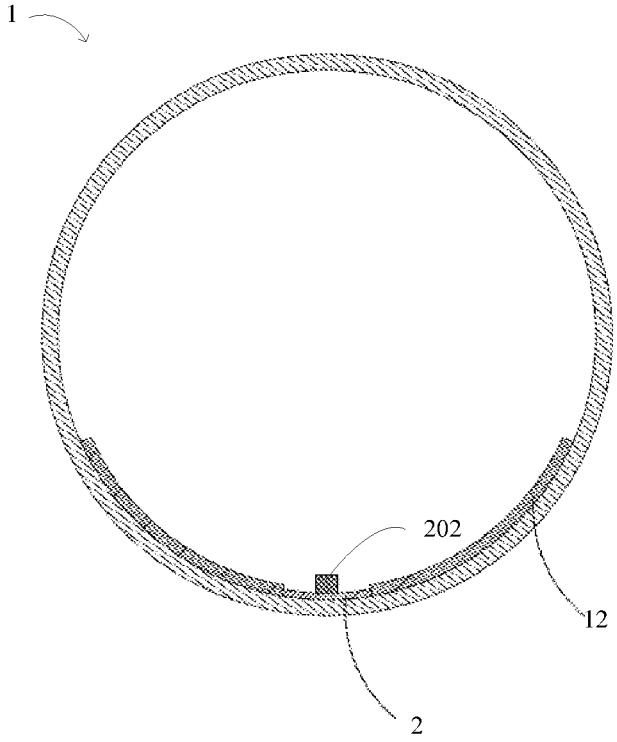
FIG. 14 is an end cross-sectional view of the lamp tube of the LED tube lamp of yet another embodiment of present invention as taken along axial direction thereof.

In the embodiment shown in FIGS. 12-14, the inner circumferential surface of the glass lamp tube, can be coated and/or covered entirely or partially with an optical diffusion coating layer (parts that have the reflective film would not be coated by the optical diffusion coating). The optical diffusion coating is preferably applied to the outer surface at the end region of the lamp tube 1, so that the end cap 3 and the lamp tube 1 can be bonded more firmly.

Referring to FIG. 15, the LED light source 202 may be further modified to include a LED lead frame 202*b* having a recess 202*a*, and an LED chip 18 disposed in the recess 202*a*. Specifically, the traditional dimension of the LED chip 18 is in square shape of the length side to the width side at a ratio about 1:1. In the present invention, the LED chip 18 can be in rectangular shape as a strip with the dimension of the length side to the width side at a ratio range from 2:1 to 10:1, preferably at a ratio range from 2.5:1 to 5:1, and further preferably at a ratio range from 3:1 to 4.5:1. As a result, the length direction of the LED chip 18 is arranged and extending along with the length direction of the lamp tube 1 to improve the average circuit density of the LED chip 18 and the overall illumination field shape of the lamp tube 1. The recess 202*a* is filled with phosphor, the phosphor coating is covered on the LED chip 18 to convert to the desired color light. In one lamp tube 1, there are multiple number of LED light sources 202, which are arranged into one or more rows, each row of the LED light sources 202 is arranged along the axis direction or length direction (Y-direction) of the lamp tube 1. The recess 202*a* belonging to each LED lead frame 202*b* may be one or more. In the illustrated embodiment, each LED lead frame 202*b* has one recess 202*a*, and correspondingly, the LED lead frame 202*b* includes two first sidewalls 15 arranged along a length direction (Y-direction) of the lamp tube 1, and two second sidewalls 16 arranged along a width direction (X-direction) of the lamp tube 1. In the present embodiment, the first sidewall 15 is extending along the width direction (X-direction) of the lamp tube 1, the second sidewall 16 is extending along the length direction (Y-direction) of the lamp tube 1. The first sidewall 15 is lower in height than the second sidewall 16. The recess 202*a* is enclosed by the first sidewalls 15 and the second sidewalls 16. In other embodiments, in one row of the LED light sources, it is permissible to have one or more sidewalls of the LED lead frames of the LED light sources to adopt other configuration or manner of extension structures. When the user is viewing the along the X-direction toward the lamp tube, the second sidewall 16 can block the line of sight of the user to the LED light source 202, thus reducing unappealing grainy spots. The first sidewall 15 can be extended along the width direction of the lamp tube 1, but as long as being extended along substantially similar to the width direction to be considered sufficient enough, and without requiring to be exactly parallel to the width direction of the lamp tube 1, and may be in a different structure such as zigzag, curved, wavy, and the like. The second sidewall 16 can be extended along the length direction of the lamp tube 1 but as long as being extended along substantially similar to the length direction to be considered sufficient enough, and without requiring to be exactly parallel to the length direction of the lamp tube 1, and may be in a different structure such as zigzag, curved, wavy, and the like. Having the first sidewall 15 being of a lower height than the second sidewall 16 is beneficial for allowing light illumination to be easily dispersed beyond the LED lead frame 202*b*, and no grainy effect is produced upon viewing in the Y-direction. The first sidewall 15 includes an inner surface 15*a* . The inner surface 15*a* of the first sidewall 15 is a sloped surface, which promotes better light guiding effect for illumination and facing toward outside of the recess. The inner surface 15*a* can be a flat or curved surface. The slope of the inner surface 15*a* is between about 30 degrees to 60 degrees. In other words, the included angle between the bottom surface of the recess 202*a* and the inner surface 15*a* is between 120 and 150 degrees. In other embodiments, the slope of the inner surface of the first sidewall can also be between about 15 degrees to 75 degrees, that is, the included angle between the bottom surface of the recess 202*a* and the inner surface of the first sidewall is between 105 degrees to 165 degrees. Alternatively, the slope may be a combination of flat and curved surface. In other embodiments, if there are several rows of the LED light sources 202, arranged in a length direction (Y-direction) of the lamp tube 1, as long as the LED lead frames 202*b* of the LED light sources 202 disposed in the outermost two rows (at closest to the lamp tube) along in the width direction of the lamp tube 1, are to have two first sidewalls 15 configured along the length direction (Y-direction) and two second sidewalls 16 configured in one straight line along the width direction (X-direction), so that the second sidewalls 16 are disposed on a same side of the same row are collinear to one another. However, the arrangement direction of the LED lead frames 202*b* of the other LED light sources 202 that are located between the aforementioned LED light sources 202 disposed in the outermost two rows are not limited, for example, for the LED lead frames 202*b* of the LED light sources 202 located in the middle row (third row), each LED lead frame 202*b* can include two first sidewalls 15 arranged along in the length direction (Y-direction) of the lamp tube 1, and two second sidewalls 16 arranged along in the width direction (X-direction) of the lamp tube 1, or alternatively, each LED lead frame 202*b* can include two first sidewalls 15 arranged along in the width direction (X-direction) of the lamp tube 1, and two second sidewalls 16 arranged along in the length direction (Y-direction) of the lamp tube 1, or arranged in a staggered manner. When the user is viewing from the side of the lamp tube along the X-direction, the outermost two rows of the LED lead frames 202*b* of the LED light sources 202 can block the user's line of sight for directly seeing the LED light sources 202. As a result, the visual graininess unpleasing effect is reduced. Similar to the present embodiment, with regard to the two outermost rows of the LED light sources, one or more of the sidewalls of the LED lead frames of the LED light sources to adopt other configurational or distribution arrangement. When multiple number of the LED light sources 202 are distributed or arranged along the length direction of the lamp tube in one row, the LED lead frames 202*b* of the multiple number of the LED light sources 202 have all of the second sidewalls 16 thereof disposed in one straight line along the width direction of the lamp tube, respectively, that is to say, being at the same side, the second sidewalls 16 form substantially a wall structure to block the user's line of sight from seeing directly at the LED light source 202. When the multiple number of the LED light sources 202 are distributed or arranged along the length direction of the lamp tube in multiple rows, the multiple number of the LED light sources 202 are distributed or arranged along the width direction, with regard to the two outermost rows of the LED light sources located along the width direction of the lamp tube, each row of the LED lead frames 202*b* of the multiple number of the LED light sources 202, in which all of the second sidewalls 16 disposed at the same side are in one straight line along the width direction of the lamp tube, that is to say, being at the same side, as long as the second sidewalls 16 of the LED light sources 202 located at the outermost two rows can block the user's line of sight for directly seeing the LED light sources 202, the reduction of visual graininess unpleasing effect can thereby be achieved. Regarding the one or more middle row(s) of the LED light sources 202, the arrangement, configuration or distribution of the sidewalls are not specifically limited to any particular one, and can be same as or different from the arrangement and distribution of the two outermost rows of the LED light sources, without departing from the spirit and scope of present disclosure.

In one embodiment, the LED light bar includes a dielectric layer and one wiring layer, in which the dielectric layer and the wiring layer are arranged in a stacking manner.

The narrowly curved end regions of the glass tube can reside at two ends, or can be configured at just one end thereof in different embodiments. In alternative embodiments, the LED tube lamp further includes a diffusion layer (not shown) and a reflective film layer 12, in which the diffusion layer is disposed above the LED light sources 202, and the light emitting from the LED light sources 202 is passed through the diffusion layer and the lamp tube 1. Furthermore, the diffusion film layer can be an optical diffusion covering above the LED light sources without directly contacting thereof. In addition, the LED light sources 202 can be bondedly attached to the inner circumferential surface of the lamp tube. In other embodiments, the magnetic member 9 can be a magnetic substance that is magnetic without being made of metal. The magnetic substance can be mixed into the hot melt adhesive.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

We claim:

1. An LED tube lamp, comprising:

a lamp tube; and an end cap, comprising:

an electrically insulating tubular part;

a magnetic metal member, disposed on an inner circumferential surface of the electrically insulating tubular part; and an adhesive disposed on an inner circumferential surface of the magnetic metal member;

wherein the lamp tube includes a main region, a transition region and an end region, the transition region being arc-shaped at both ends has a length of 1 mm to 4 mm, the end cap is sleeved with the end region of the lamp tube, and an outer diameter of the end region is less than an outer diameter of the main region, the outer diameter difference between the end region and the main region is 1 mm to 10 mm, and wherein the magnetic metal member is for melting the adhesive.

2. An LED tube lamp, comprising:

a lamp tube; and two end caps, at least a first end cap comprising:

an electrically insulating tubular part;

a magnetic metal member, disposed on an inner circumferential surface of the electrically insulating tubular part; and an adhesive disposed on an inner circumferential surface of the magnetic metal member;

wherein the lamp tube includes a main region, a transition region and an end region, the transition region being arc-shaped at both ends, the first end cap is sleeved with the end region of the lamp tube, and an outer diameter of the end region is less than an outer diameter of the main region, and wherein the magnetic metal member is for melting the adhesive.

3. The LED tube lamp of claim 2, wherein the transition region has a length of 1 mm to 4 mm.

4. The LED tube lamp of claim 2, wherein the outer diameter difference between the end region and the main region is 1 mm to 10 mm.

5. The LED tube lamp of claim 2, wherein the sizes of the two end caps are different.

6. The LED tube lamp of claim 5, wherein the size of one end cap is 30%-80% of the size of the other end cap.

7. The LED tube lamp of claim 2, wherein the inner circumferential surface of the magnetic metal member is fully covered by the adhesive.

8. The LED tube lamp of claim 2, wherein the magnetic metal member is a ring.

9. The LED tube lamp of claim 8, wherein the magnetic metal member is a circular ring.

10. The LED tube lamp of claim 8, wherein the magnetic metal member is an oval ring.

11. The LED tube lamp of claim 2, wherein the magnetic metal member contains at least one opening.

12. The LED tube lamp of claim 11, wherein the at least one opening of the magnetic metal member occupies 10% to 50% of the area of the magnetic metal member.

13. The LED tube lamp of claim 11, wherein the at least one opening is a plurality of openings arranged circumferentially around the magnetic metal member in an equidistantly spaced manner.

14. The LED tube lamp of claim 11, wherein the at least one opening is a plurality of openings arranged circumferentially around the magnetic metal member in a not equally spaced manner.

15. The LED tube lamp of claim 2, wherein the magnetic metal member has an indentation structure on a surface thereof.

16. The LED tube lamp of claim 15, wherein the indentation structure of the magnetic metal member protrudes from an inner surface of the magnetic metal member toward an outer surface of the magnetic metal member.

17. The LED tube lamp of claim 15, wherein the indentation structure of the magnetic metal member protrudes from an outer surface of the magnetic metal member toward an inner surface of the magnetic metal member.

18. The LED tube lamp of claim 2, wherein the magnetic metal member is tubular and configured with a same axis of the electrically insulating tubular part of the end cap.

19. The LED tube lamp of claim 2, wherein:

the lamp tube is a glass tube; and the adhesive is a hot melt adhesive contacting an outer circumferential surface of the glass tube and the inner circumferential surface of the magnetic metal member.

20. The LED tube lamp of claim 19, wherein:

the magnetic metal member is configured to heat up upon being subjected to an electromagnetic field.

21. The LED tube lamp of claim 2, wherein the magnetic metal is configured to heat up upon being subject to an electromagnetic field.

* * * * *